US005229246A

United States Patent [19]

Shibata et al.

[11] Patent Number: 5,229,246

[45] Date of Patent: Jul. 20, 1993

[54] PHOTOGRAPHIC MATERIALS CONTAINING POLYSACCHARIDES

[75] Inventors: Takeshi Shibata; Takuya Yokokawa, both of Kanagawa, Japan

[73] Assignee: Fuji Photo Film Co., Ltd., Kanagawa, Japan

[21] Appl. No.: 656,529

[22] Filed: Feb. 19, 1991

[30] Foreign Application Priority Data

Feb. 20, 1990 [JP] Japan ..... 2-39296
Apr. 6, 1990 [JP] Japan ..... 2-100101
Apr. 20, 1990 [JP] Japan ..... 2-103105

[51] Int. Cl.[5] ..... G03C 5/54; G03C 1/04

[52] U.S. Cl. ..... 430/217; 430/203; 430/213; 430/214; 430/215; 430/216; 430/639; 430/640; 430/935; 430/212

[58] Field of Search ..... 430/203, 213, 216, 215, 430/217, 639, 640, 935, 214, 212

[56] References Cited

U.S. PATENT DOCUMENTS 3,250,620 5/1966 Lovett et al. ..... 430/639
4,569,900 2/1986 Takagi .
4,820,622 4/1989 Hirai ..... 430/203
5,051,349 9/1991 Taguchi et al. ..... 430/203

FOREIGN PATENT DOCUMENTS 0137223 4/1985 . European Pat. Off. .

*Primary Examiner*—Richard L. Schilling
*Attorney, Agent, or Firm*—Sughrue, Mion, Zinn, Macpeak & Seas

[57] ABSTRACT

A diffusion transfer photographic material is disclosed, which comprises a support having thereon at least a photosensitive element comprising a photosensitive silver halide emulsion and a diffusible dye donating compound, and a dye fixing element which is placed upon the said photosensitive element at the time of image transfer, wherein a natural macromolecular polysaccharide originating from red algae is included in said photosensitive element and/or in said dye fixing element, and a process of producing a diffusion transfer photographic material is disclosed, which comprises the step of using a coating liquid which contains a water soluble polymer solution comprising a natural macromolecular polysaccharide, a hydrophilic organic solvent in which the said water soluble polymer is essentially insoluble and water.

6 Claims, No Drawings

PHOTOGRAPHIC MATERIALS CONTAINING POLYSACCHARIDES

FIELD OF THE INVENTION

The invention concerns diffusion transfer photographic materials, and in particular it concerns photographic materials for diffusion transfer purposes in which various photographic characteristics have been improved.

The invention also concerns heat developable color photosensitive elements, and in particular it concerns heat developable color photosensitive elements with which positive images having a high maximum density can be obtained The invention also concerns a method of coating water soluble polymers, and in particular it concerns a method of coating water soluble polymers, in which there is an improvement in evenness of the coating.

BACKGROUND OF THE INVENTION

The photographic technique in which silver halides are used is superior the electrophotographic and diazophotographic techniques with respect to photographic characteristics such as photographic speed and gradation control. Accordingly, in the past this has been the most widely used technique.

These silver halide photographic techniques include wet processing type color diffusion transfer techniques in which a dye fixing element which has a dye fixing layer is laminated with a photosensitive element which has a silver halide emulsion layer Further, an alkaline processing composition is spread in the form of a layer within this laminate or the laminate is immersed in an alkaline processing fluid.

Furthermore, techniques in which diffusible dyes are produced or released in correspondence or in counter-correspondence to the reaction when a photosensitive silver halide and/or organic silver salt is reduced to silver by thermal development and in which the diffusible dyes are transferred to a dye fixing element have been developed more recently. Such techniques have been disclosed, for example, in U.S. Pat. Nos. 4,463,079, 4,474,867, 4,478,927, 4,507,380, 4,500,626 and 4,483,914, JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-62-65038, JP-A-61-23245, and European Patents laid open 210,660A2 and 220,746A2. (The term "JP-A" as used herein signifies an "unexamined published Japanese patent application".)

However, with such image forming techniques some dye transfer occurs when, after image formation, a dye fixing element is stored on top of another dye fixing element under conditions of high humidity and there is sometimes a loss of image density. Problems can also arise with so-called color transfer where the white base of the dye fixing element becomes colored. Moreover, with the above mentioned method of image formation, the dye fixing element is likely to curl, especially under conditions of low humidity. There are also problems with uneven transfer due to the fact that the contact with the photosensitive element at the time of image formation is not made satisfactorily, and with the possible occurrence of transportation failure in the image formation processing apparatus.

Moreover, when image formation is carried out after ageing and storage with the method of image formation described above, pronounced staining of the white base may occur and there is the further problem that color impurity may arise.

Furthermore, the use of polysaccharides such as dextran and pluran in addition to gelatin or in place of gelatin as the binder for the constituting layers of diffusion transfer photographic photosensitive materials has been disclosed in JP-A-62-47636. However, coated layers which contain dextran and pluran cannot be used in drying methods in which gelation is employed, because of the problem of drying attachment.

Heat developable photosensitive elements and the processes involved therein which are known in this field of technology have been described, for example, in *The Basics of Photographic Optics*, Non-silver salt photography edition, pages 242–255 (published by Corona, 1982), and in U.S. Pat. No. 4,500,626.

Many methods have been proposed for obtaining positive color images by means of thermal development.

For example, a method has been proposed in U.S. Pat. No. 4,559,290 a compound sometimes using known as a DDR compound in its oxidized form (which has no dye releasing capacity) and a reducing agent or a precursor thereof. The reducing agent is oxidized in accordance with the exposure of the silver halide by thermal development. The compound is then reduced by the remaining reducing agent which has not been oxidized and releases a diffusible dye. Furthermore, heat developable color photosensitive elements in which non-diffusible compounds which release diffusible dyes as a result of the reductive cleavage of an N—X bond (where X represents an oxygen, nitrogen or sulfur atom) are used as compounds which release diffusible dyes via a similar mechanism have been disclosed in European Patent Laid Open 220,746 and in *Kokai Giho* 87–6199 (Volume 12, No. 22).

Electron donors and electron transfer agents are generally used conjointly as the reducing agent in the methods of positive image formation in which reducible dye donating compounds of the type described above are employed.

However, with methods of image formation wherein an electron transfer agent is combined with an electron donor of this type and heat development is carried out, the capacity for reducing silver halide to silver is increased and there is the problem that the maximum density of the positive image is reduced because this reduction reaction occurs even in the unexposed parts.

Furthermore, various improvements have been made with the coating apparatus, the method of drying and the coating liquid formulation to ensure that coating liquids are coated uniformly on the support.

In these improvements, use is generally made of a water soluble binder which undergoes a reversible sol/gel transformation when the aqueous solution is heated and cooled. Methods in which the coated layer is established on a support are generally used in the photographic industry for example.

However, uneven coating is likely to arise as a result of the drying in the case of dilute aqueous solutions of the above mentioned water soluble polymers and in cases wherein a substance which inhibits gelation is added to the coating liquid. Furthermore, unevenness in the thickness of the coated layer arises as a result of the phenomenon known as ribbing when a coating step is carried out on a support which has a certain degree of roughness.

The occurrence of such uneven coated layers and uneven thickness results in a reduction of the quality of the intended product. In particular, when the intended product is a photographic element (a photosensitive element or an image receiving element), there is the problem that photographic quality is not constant For example, if such an unevenness of coating or unevenness of coated thickness arises in the image receiving layer (known as the dye fixing layer) which is used for forming an image by the transfer of image forming components from a photosensitive element, the diffusion distance of the image forming components will differ somewhat depending on the location. Further, there may be parts where there is no contact between the photosensitive element and the image receiving material Unevenness will therefore arise in the image which is formed and only a low quality image will be obtained.

In particular, in cases where natural macromolecular polysaccharides (for example, natural macromolecular polysaccharides originating from red algae such as phaeceleran and carrageenans for example, and natural macromolecular polysaccharides obtained by fermentation such as "Jelan gum" for example) are used as water soluble polymers which undergo reversible sol/gel transformation when an aqueous solution is heated and cooled, the powders are difficult to dissolve in water. Undissolved lumps known as "dama" or "mamako" are likely to be formed and they are likely to result in unevenness on coating.

SUMMARY OF THE INVENTION

The objects of the present invention include diffusion transfer photographic photosensitive materials with which color images which exhibit little color transfer can be formed, diffusion transfer photographic photosensitive materials with which color photographs with little curl can be obtained, diffusion transfer photographic materials which have excellent storage stability prior to image formation, and diffusion transfer photographic photosensitive materials which provide these qualities and with which there is little drying attachment at the time of manufacture.

Furthermore, this invention is intended to provide heat developable photosensitive elements with which positive images which have a high maximum density can be obtained.

Furthermore, this invention is intended to provide a method of coating water soluble polymers with which unevenness of coating and non-uniformity of coating thickness do not arise.

These and other objects of the invention have been realized by means of a diffusion transfer photographic material comprising a support having thereon at least a photosensitive element comprising a photosensitive silver halide and a diffusible dye donating compound, and a dye fixing element which is placed upon the said photosensitive element at the time of image transfer, wherein a natural macromolecular polysaccharide originating from red algae is included in the photosensitive element and/or in the dye fixing element.

Furthermore, the above mentioned objects of the invention have been achieved by means of a method of coating water soluble polymers, characterized a coating liquid which contains a solution comprising a water soluble polymer which undergoes a reversible sol/gel transformation on heating and cooling an aqueous solution, a hydrophilic solvent in which the water soluble polymer is essentially insoluble and water.

In particular, the above mentioned objects of the invention are achieved by means of a method of coating a water soluble polymer, characterized by a coating liquid which contains a solution of the water soluble polymer which has been obtained by dispersing the aforementioned water soluble polymer in the aforementioned hydrophilic organic solvent and then adding water to form the solution, or by dissolving the aforementioned water soluble polymer in a mixed solution of the aforementioned hydrophilic organic solvent and water.

DETAILED DESCRIPTION OF THE INVENTION

The natural polymeric polysaccharides obtained by extraction and refinement from red algae disclosed in Table 1 on page 21 of *Shokuhin Kogyo*, Volume 31, (1988) are among the natural macromolecular polysaccharides originating from red algae which can be used in the present invention. In many cases the natural macromolecular polysaccharides obtained by extraction and refinement from red algae are mixtures of various materials. These mixtures can be used without further treatment in the present invention, or single substances of high purity can be used.

Among the natural macromolecular polysaccharides originating from red algae which can be used in the present invention, agar, κ-carrageenan, λ-carrageenan, ι-carrageenan and phaeceleran are preferable. κ-carrageenan is more preferable. These substances can be procured as commercial products. For example, κ-carrageenan can be obtained as "Taito Gelling Agent NK-4" which is made by the Taito Co., and a mixture of λ-carrageenan with trace amounts of κ-carrageenan can be obtained as "Taito Gelling Agent MV" which is also made by the Taito Co.

The amount of the natural macromolecular polysaccharide originating from red algae for the present invention can be set arbitrarily, but an amount of from 0.005 to 10 grams, and especially of from 0.02 to 4 grams, per square meter on each side of support is appropriate.

The natural macromolecular polysaccharides originating from red algae of the present invention may be used only in the photosensitive element, only in the dye fixing element, or in both the photosensitive element and the dye fixing element of a diffusion transfer photographic material. Moreover, when used in the photosensitive element, the polysaccharides may be added to and used in any layer, such as a layer which contains photosensitive silver halide, a layer which contains a diffusible dye donating compound (this may be the same layer as that which contains the silver halide), a protective layer, an intermediate layer which is established between photosensitive layers of different color sensitivity, an under-layer or a backing layer. But they are preferably used in a photographic constituting layer on the same side as the photosensitive silver halide layer. When used in a dye fixing element, the polysaccharides may be in the dye fixing layer, a protective layer, an under-layer or a backing layer for example, but they are preferably used in a photographic constituting layer on the same side as the dye fixing layer.

The polysaccharides are especially effective for preventing color transfer when used in a dye fixing element protective layer.

These macromolecular polysaccharides can be used conjointly with various other hydrophilic binders.

In practice, transparent or semi-transparent hydrophilic binders are preferred. Examples include proteins such as gelatin and gelatin derivatives, cellulose derivatives, polysaccharides such as starch, gum arabic, dextran and pluran, poly(vinyl alcohol), polyvinylpyrrolidone, acrylamide polymers, poly(acrylic acid), poly(acrylic acid salts) and other synthetic macromolecular materials. Furthermore, the polymers which have a high water uptake disclosed, for example, in JP-A-62-245260, which is to say homopolymers of vinyl monomers which have a —COOM group or an —$SO_3M$ group (where M is a hydrogen atom or an alkali metal) or copolymers of these monomers with other vinyl monomers (for example, sodium methacrylate, ammonium methacrylate, Sumikagel L-5H made by the Sumitomo Chemical Co.) can also be used. Combinations of two or more of these binders can also be used.

Furthermore, combinations with rubbers such as natural compounds (e.g., roast bean gum, tara gum and guar gum), can also be used.

The photosensitive elements of the present invention are comprised fundamentally of a photosensitive silver halide emulsion and a diffusible dye donating compound on a support, and various additives such as reducing agents for example can also be used as required. These components are often added to the same layer, but if they are in a reactive state they can be added to separate layers. For example, any loss of speed is avoided if the diffusible dye donating compounds which give rise to a coloration are included in a layer below the silver halide emulsion.

In order to obtain a wide range of colors on the chromacity chart using the three primary colors yellow, magenta and cyan, combinations of silver halide emulsion layers which are photosensitive to at least three different spectral regions are combined. For example, there are blue sensitive layer, green sensitive layer and red sensitive layer combinations and green sensitive layer, red sensitive layer and infrared photosensitive layer combinations. The photosensitive layers can be arranged in a variety of known arrangements and orders. Furthermore, each photosensitive layer can be divided into two or more layers, as required.

Various auxiliary layers, such as protective layers, under-layers, intermediate layers, yellow filter layers, anti-halation layers, backing layers, neutralizing layers, timing layers and peeling players for example, can also be included in the photosensitive element.

All of the silver halides, including silver chloride, silver bromide, silver iodobromide, silver chlorobromide, silver chloroiodide and silver chloroiodobromide, can be used in the present invention.

The silver halide emulsions used in the present invention may be surface latent image type emulsions or internal latent image type emulsions. Internal latent image type emulsions are combined with nucleating agents or light fogging and used as direct reversal emulsions. Furthermore, so-called core/shell emulsions which have phases which have different compositions within the grain and on the grain surface layer can also be used. The silver halide emulsion may be mono-disperse or poly-disperse, and mixtures of mono-disperse emulsions can be used.

The grain size is from 0.1 to 2 μ, and most desirably from 0.2 to 1.5 μ. The crystal habit of the silver halide grains may be cubic, octahedral, tetradecahedral, tabular with a high aspect ratio or of some other form.

In practice, any of the silver halide emulsions disclosed, for example, in column 50 of U.S. Pat. No. 4,500,626, U.S. Pat. No. 4,628,021, *Research Disclosure* (referred to hereinafter as RD) 17029 (1978), and JP-A-62-253159 can be used.

The silver halide emulsions can be sued after ripening, but they are generally used after chemical sensitization. The known methods of sulfur sensitization, reduction sensitization, precious metal sensitization and selenium sensitization, for example, can be used individually or in combinations with the emulsions for the normal type of photosensitive element. These methods of chemical sensitization can also be carried out in the presence of a nitrogen containing heterocyclic compound (JP-A-62-253159).

However, for the photosensitive element for heat-development, those halides which have a silver bromide content of at least 50 mol·% are desirable for obtaining images which have a better S/N ratio. Furthermore, the use of those which have a silver iodide content of not more than 10 mol·% is desirable for minimizing the staining which arises after delayed development. Moreover, those halides in which the silver chloride content is 40 mol·% or less are desirable for minimizing the loss in maximum density which is produced by fogging during thermal development.

Furthermore, each photosensitive layer may consist of two or more emulsions which have different halogen compositions. Mixtures of emulsions which have different grains structures, grain forms, grain sizes, chemical sensitization, sensitizing dyes, pH, pAg, conductivity etc. are frequently used in order to achieve the intended photographic speed and gradation.

The emulsions used for the photosensitive element for heat-development in the present invention are preferably monodisperse emulsions. Here, a mono-disperse emulsion is one which has a grain size distribution such that the variation coefficient ($S/\bar{r}$) for the grain size of the silver halide grains is not more than 0.25. Here, $\bar{r}$ is the average grain size and S is the standard deviation of the grain size. That is to say, if the size of each individual grain is ri and the number of individual grains is ni, the average grain size $\bar{r}$ is defined by the following expression:

$$\bar{r} = \frac{\Sigma\, ni \cdot ri}{\Sigma\, ni}$$

Moreover, the standard deviation S is defined by the following expression:

$$\sqrt{\frac{\Sigma\, (\bar{r} - ri)^2 \cdot ni}{\Sigma\, ni}}$$

The performance advantage of mono-disperse emulsions is that the fogging which is produced during thermal development is minimized so that a loss of maximum density is less likely to arise. Thus, when chemical sensitization of an emulsion is carried out there is naturally an increase in fog level as well as an increase in photographic speed. This fogging is especially pronounced as a feature of thermal development when compared to conventional photosensitive materials (color papers, color negatives etc.) with which liquid development is generally used.

On the other hand, the optimum point of chemical sensitization for an emulsion has long been known to be greatly dependent on the grain size. Hence, even with emulsions which have the same average grains size, more grains can be chemically sensitized close to the optimum level in cases where a mono-disperse emulsion is being used. Conversely, in the case of a poly-disperse emulsion the small size grains are not chemically sensitized adequately and the photographic speed is reduced while the large sized grains are chemically sensitized to excess. This results in a high fog level and, overall, the performance is that of soft contrast, low speed and a high fog level.

The superiority of the mono-disperse emulsions described here could be predicted to a certain extent from the trends from the findings of conventional photosensitive materials. But, when dealing with heat developable photosensitive elements it is known that the pronounced trends are such that they could not have been predicted on the basis of conventional materials. Hence, the use of mono-disperse emulsions is very important when designing heat developable photosensitive elements.

The effect of the natural macromolecular polysaccharides originating from red algae of the present invention in terms of the reduction of fogging during thermal development is also effective against the rise in fog level which arises with the chemical sensitization of the emulsion. But it is also clear from the explanation given above that the fog level is reduced to a more ideal level when mono-disperse emulsions are used and so photosensitive elements which have a high maximum density are obtained.

Furthermore, chemical sensitization is important for providing photosensitive elements of high photographic speed of course and this is generally the same as for a conventional sensitive material.

Furthermore, with respect to heat-development, the inventors have reported before that with gold/sulfur sensitization, fogging is especially likely to occur and that the optimum amount of gold is from $1\times10^{-7}$ to $1.0\times10^{-5}$ per mol of silver (JP-A-1-233440). Hence, the present invention can be recognized as being especially effective in mono-disperse emulsions which have been gold/sulfur sensitized.

The coated weight of photosensitive silver halide used in the present invention is within the range from 1 mg to 10 grams per square meter calculated as silver.

The silver halide used in this invention may be spectrally sensitized with methine dyes or by other means. The dyes which may be used include cyanine dyes, merocyanine dyes, complex cyanine dyes, complex merocyanine dyes, holopolar cyanine dyes, hemi-cyanine dyes, styryl dyes and hemi-oxonol dyes.

Examples include the sensitizing dyes disclosed, for example, in U.S. Pat. No. 4,617,257, JP-A-59-180550, JP-A-60-140335 and RD 17029 (1978) pages 12–13.

These sensitizing dyes can be used individually, or combinations of these dyes can be used. Combinations of sensitizing dyes are often used especially with the aim of achieving super-sensitization.

Compounds which exhibit super-sensitization, which is to say dyes which themselves have no spectrally sensitizing action or compounds which essentially do not absorb visible light (for example, those disclosed in U.S. Pat. No. 3,615,641 and JP-A-63-23145), may be included together with the sensitizing dyes.

These sensitizing dyes may be adsorbed to the emulsion during, before or after chemical sensitization, and they may be added before or after nuclei formation for the silver halide grains as disclosed in U.S. Pat. Nos. 4,183,756 and 4,225,666. The amount adsorbed is generally from $10^{-8}$ to $10^{-2}$ mol per mol of silver halide.

Methods of using various sensitizing dyes can be applied to heat developable photosensitive elements of the present invention as described above, but those methods in which sensitizing dyes are added prior to chemical sensitization are preferred. This is because emulsions to which sensitizing dyes have been added prior to chemical sensitization exhibit less fogging at high photographic speeds than comparative emulsions and because the fog reducing effect of the natural macromolecular polysaccharides originating from red algae of the present invention is more pronounced under these conditions.

The diffusible dye donating compounds of the present invention are compounds which generate or release diffusible dyes in accordance with the reaction or in counter-accordance with the reaction when a silver ion is reduced to silver. These compounds are all referred to hereinafter as dye donating compounds for the sake of simplicity.

Examples of dye donating compounds which can be used in the present invention include first of all the compounds (couplers) which form dyes by means of an oxidative coupling reaction. These couplers may be four-equivalent couplers or two-equivalent couplers, but two-equivalent couplers which have a non-diffusible group as a leaving group and form a diffusible dye by means of an oxidative coupling reaction are preferred. The non-diffusible group may take the form of a polymer chain. Examples of color developing agents and couplers have been described in detail in, for example, *The Theory of the Photographic Process*, by T.H. James, fourth edition, pages 291–334 and 354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Furthermore, compounds which have the function of releasing or dispersing dispersible dyes in the form of the image are another type of dye donating compound. Compounds of this type can be represented by the general formula (LI) indicated below:

$$(\text{Dye-Y})_n\text{—Z} \qquad \text{(LI)}$$

Here, Dye represents a dye group, a dye group which has been temporarily shifted to the short wave length side or a dye precursor group; Y represents a single bond or a linking group; Z represents a group which produces a difference in the diffusibility of the compound represented by $(\text{Dye-Y})_n$—Z, or which releases Dye and produces a difference in the diffusibilities of the released Dye and $(\text{Dye-Y})_n$—Z, in accordance or in counter-accordance with the photosensitive silver salt in which a latent image has been formed in the form of the image; and n represents 1 or 2, and when n is 2 the two Dye-Y moieties may be the same or different.

Examples of dye donating compounds represented by general formula (LI) include the compounds described under the headings (1) to (5) below. Moreover, the compounds described under the headings (1) to (3) below form diffusible dye images in counter-accordance with the development of the silver halide (positive dye images) and those described under the headings (4) and (5) form diffusible dye images in accordance with the development of the silver halide (negative dye images):

(1) Dye developing agents in which a dye component is connected with a hydroquinone based developing agents as disclosed, for example, in U.S. Pat. Nos. 3,134,764, 3,362,819, 3,597,200, 3,544,545 and 3,482,972. These dye developing agents are diffusible under alkaline conditions but are rendered non-diffusible on reaction with silver halide.

(2) Non-diffusible compounds which release a diffusible dye under alkaline conditions but which lose this ability on reaction with silver halide as disclosed in U.S. Pat. No. 4,503,137. Examples include the compounds which release diffusible dyes by means of an intramolecular nucleophilic substitution reaction disclosed in U.S. Pat. No. 3,980,479 and the compounds which release diffusible dyes by means of an intramolecular substitution reaction of a iso-oxazolone ring as disclosed in U.S. Pat. No 4,199,354.

(3) Non-diffusible compounds which react with reducing agents which remain unoxidized by development and release diffusible dyes as disclosed, for example, in U.S. Pat. No. 4,559,290, European Patent 220,746A2, U.S. Pat. No. 4,783,396 and Kokai Giho 87-6199.

Examples include: compounds which release diffusible dyes by means of an intramolecular nucleophilic substitution reaction after reduction disclosed, for example, in U.S. Pat. Nos. 4,139,389 and 4,139,379, JP-A-59-185333 and JP-A-57-84453; compounds which release a diffusible dye by means of an intramolecular electron transfer reaction after reduction disclosed, for example, in U.S. Pat. No. 4,232,107, JP-A-59-101649, JP-A-61-88257 and RD 24025 (1984); compounds which release a diffusible dye via single bond cleavage after reduction disclosed, for example, in West German Patent 3,008,588A, JP-A-56-142530, and U.S. Pat. Nos. 4,343,893 and 4,619,884, the nitro compounds which release diffusible dyes after accepting an electron disclosed, for example, in U.S. Pat. No. 4,450,223 and the compounds which release diffusible dyes after accepting an electron disclosed, for example, in U.S. Pat. No. 4,609,610.

More desirable are compounds which have electron withdrawing groups and an N—X bond (where X represents an oxygen, sulfur or nitrogen atom) within the molecule disclosed, for example, in European Patent 220,746A2, Kokai Giho 87-6199, U.S. Pat. No. 4,783,396, JP-A-63-201653 and JP-A-63-201654, compounds which have electron withdrawing groups and an $SO_2$—X bond (where X has the same significance as described above) within the molecule disclosed in JP-A-1-26842, compounds which have electron withdrawing groups and a PO—X bond (where X has the same significance as described above) within the molecule as disclosed in JP-A-63-271344, and compounds which have electron withdrawing groups and a C—X' bond (where X' is the same as X or —$SO_2$—) disclosed in JP-A-63-271341. Furthermore, compounds which release diffusible dyes on the cleavage of a single bond after reduction by means of a $\pi$-bond which is conjugated with an electron accepting group disclosed in JP-A-1-161237 and JP-A-1-161342 can also be used.

From among these compounds, those which have an electron withdrawing group and an N-X bond within the molecule are especially desirable. Examples include compounds (11)–(23) disclosed in Kokai Giho 87-6199, and compounds (1)–(3), (7)–(10), (12), (13), (15), (23)–(26), (31), (32), (35), (36), (40), (41), (44), (53)–(59), (64) and (70) disclosed in U.S. Pat. No. 4,783,396 and in European Patent 220,746A2.

(4) Compounds which release diffusible dyes by means of a reaction with the oxidized form of a reducing agent, being couplers which have a leaving group (DDR couplers). Examples include those disclosed in British Patent 1,330,524, JP-B-48-39165 and U.S. Pat. Nos. 3,443,940, 4,474,867 and 4,483,914. (The term "JP-B" as used herein signifies an "examined Japanese patent publication".)

(5) Compounds which are reducing with respect to silver halide or organic silver salts and which release diffusible dyes on reduction (DRR compounds). These compounds can be used dispense with other reducing agents and so there are no problem with image staining due to oxidative degradation of the reducing agent. Therefore, these compounds are desirable. Examples have been disclosed, for example, in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116537, JP-A-57-179840 and U.S. Patent 4,500,626. Examples of DDR compounds include the compounds disclosed in columns 22 to 44 of the aforementioned U.S. Pat. No. 4,500,626. Compounds (1)–(3), (10)–(13), (16)–(19), (28)–(30), (33)–(35), (38) –(40) and (42)–(64) disclosed in the aforementioned U.S. Patent are preferred. Furthermore, the compounds disclosed in columns 37–39 of U.S. Pat. No. 4,639,408 can also be preferably used.

Additionally, the dye-silver compounds in which a dye is bonded to an organic silver salt (*Research Disclosure* May 1978, pages 54–58 for example), the azo dyes which are used in the heat-developable silver dye bleach method (U.S. Pat. No. 4,235,957, *Research Disclosure*, April 1976, pages 30–32 for example), and leuco dyes (U.S. Pat. Nos. 3,985,565 and 4,022,617 for example) can also be used as dye donating compounds other than the couplers and compounds of general formula (LI) described above.

Various anti-fogging agents or photographic stabilizers can be used in the present invention. For example, use can be made of the azoles and azaindenes disclosed on pages 24–25 of RD 17643 (1978), the nitrogen containing carboxylic acids and phosphoric acids disclosed in JP-A-59-168442 or the mercapto compounds and their metal salts as disclosed in JP-A-59-111636 and the acetylene compounds disclosed in JP-A-62-87957.

The use of hydrophilic binders for the binder in the constituting layers of the photosensitive elements and dye fixing elements other than the layer which contains the aforementioned natural macromolecular polysaccharide originating from red algae is desirable. Examples include those disclosed on pages 26–28 of JP-A-62-253159. In practical terms, transparent or semi-transparent hydrophilic binders are preferred. Examples of these include proteins such as gelatin and gelatin derivatives, and other natural compounds such cellulose derivatives and polysaccharides such as starch, gum arabic, dextran and pluran, and poly(vinyl alcohol), polyvinylpyrrolidone, acrylamide polymers and other synthetic polymeric compounds. Furthermore, the highly water absorbent polymers disclose in JP-A-62-245260, which is to say homopolymers of vinyl monomers which have a —COOM group or an —$SO_3M$ group (where M represents a hydrogen atom or an alkali metal) or copolymers of these vinyl monomers, or copolymers of these vinyl monomers with other vinyl monomers (for example, sodium methacrylate, ammonium methacrylate, Sumikagel L-5H made by the Sumitomo Chemical Co.), can also be used. Two or more of these binders can also be used in combination.

In cases where a system in which a trace of water is supplied and thermal development is carried out, it is possible to use polymers which have a high water uptake described above to take up the water rapidly. Furthermore, when a polymer which has a high water up-take is used in a dye fixing layer or in a dye fixing layer protective layer it is possible to prevent the retransfer of dye from a dye fixing element to others once transfer has been accomplished.

The coated weight of the binder in the present invention is preferably not more than 20 grams per square meter, and more desirably it is not more than 10 grams per square meter, while most desirably it is not more than 7 grams per square meter.

Various polymer latexes can be included in a constituting layer (including the backing layers) of the photosensitive element or dye fixing element with a view to improving film properties such as providing dimensional stabilization, preventing the occurrence of curl, preventing the occurrence of sticking, preventing the formation of cracks in the film and preventing the occurrence of pressure desensitization. Examples include all of the polymer latexes disclosed, for example, in JP-A-62-245258, JP-A-62-136648 and JP-A-62-110066. In particular, it is possible to prevent the occurrence of cracking of a mordant layer when a polymer latex which has a low transition point (40° C. or less) is used in the mordant layer and an excellent anti-curl effect can be realized by using a polymer latex which has a high transition point in the backing layer.

In cases where a photosensitive element of the present invention is processed by thermal development, organometallic salts can be used conjointly as oxidizing agents along with the photosensitive silver halide. The use of organic silver salts from among these organometallic salts is especially desirable.

The benzotriazoles, fatty acids and other compounds disclosed, for example, in columns 52–53 of U.S. Pat. No. 4,500,626 can be used as organic compounds for forming the organic silver salt oxidizing agents mentioned above. Furthermore, the silver salts of carboxylic acids which have alkynyl groups, such as the silver phenylpropiolate disclosed in JP-A-60-113235, and the silver acetylenes disclosed in JP-A-61-249044, can also be used. Two r more organic silver salts can be used conjointly.

The above mentioned organic salts can be used conjointly in amounts of from 0.01 to 10 mol, and preferably of from 0.01 to 1 mol, per mol of photosensitive silver halide. The total amount of photosensitive silver halide and organic silver salt coated is suitably from 50 mg to 10 grams per square meter when calculated as silver.

In the present invention, the reducing agent may be incorporated into the photosensitive element or it may be supplied to the photosensitive element (and the dye fixing element) at the time of processing as one component of a processing composition which is contained in a burstable container. The former embodiment is preferred when processing is carried out with thermal development and the latter embodiment is preferred when processing is carried out at a near normal temperature using a so-called color diffusion transfer process.

Any of the reducing agents known in this field can be used. Furthermore, the dye donating compounds which have reducing properties described hereinafter can also be included (other reducing agents can also be used conjointly in this case). Furthermore, reducing agent precursors which themselves have no reducing properties but which achieve reducing properties as a result of the action of a nucleophilic reagent or heat during the development process can also be used.

Examples of reducing agents which can be used in the present invention include the reducing agents and reducing agent precursors disclosed, for example, in columns 49–50 of U.S. Pat. No. 4,500,626, columns 30–31 of U.S. Pat. No. 4,483,914, U.S. Pat. Nos. 4,330,617 and 4,590,152, pages 17–18 of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256, and pages 78–96 of European Patent 220,746A2.

Combinations of various reducing agents such as those disclosed in U.S. Pat. No. 3,039,869 can also be used.

In cases where a reducing agent which is non-diffusible is used, combinations with an electron transfer agent and/or an electron transfer agent precursor can be used in order to promote electron transfer between the non-diffusible reducing agent and the developable silver halide.

Electron transfer agents or precursors thereof can be selected from among the reducing agents and precursors thereof described earlier. The electron transfer agent or precursor thereof preferably has a higher degree of diffusibility than the non-diffusible reducing agent (electron donor). 1-Phenyl-3-pyrazolidones and aminophenols are especially useful electron transfer agents.

The reducing agents (electron donors) which are non-diffusible which are used in combination with the electron transfer agents should be those from among the aforementioned reducing agents which are essentially immobile in the layers of the photosensitive element. Preferred examples include hydroquinones, sulfonamidophenols, sulfonamidonaphthols, the compounds disclosed as electron donors in JP-A-53-110827 and the dye donating compounds which have reducing properties but which are non-diffusible as described hereinafter.

The amount of reducing agent added is generally from 0.001 to 20 mol, and more desirably from 0.01 to 10 mol, per mol of silver.

The hydrophobic additives such as the dye donating compounds and non-diffusible reducing agents for example can be introduced into the layers of the photosensitive element using known methods such as those described, for example, in U.S. Pat. No. 2,322,027. In this case, high boiling point organic solvents such as those disclosed, for example in JP-A-59-83154, JP-A-59-178451, JP-A-59-178452, JP-A-59-178453, JP-A-178454, JP-A-59-178455 and JP-A-59-178457 can be used conjointly with low boiling point organic solvents of a boiling point from 50° C. to 160° C., as required.

The amount of high boiling point organic solvent is generally not more than 10 grams, and preferably not more than 5 grams, per gram of dye donating compound used. Furthermore, they are suitably used in amounts of not more than 1 cc, preferably not more than 0.5 cc, and most desirably not more than 0.3 cc, per gram of binder.

The methods of dispersion with polymers disclosed in JP-B-51-39853 and JP-A-51-59943 can also be used.

In the case of compounds which are essentially insoluble in water, the compounds can be included by dispersion as fine particles in the binder as well as using the method described above.

Various surfactants can be used when hydrophobic compounds are being dispersed in a hydrophilic colloid. For example, use can be made of the surfactants disclosed on pages 37–38 of JP-A-59-157636.

Compounds which activate development and at the same time stabilize the image can be used in the photosensitive element in cases where thermal development is used for processing. Examples of compounds which are preferred have been disclosed in columns 51–52 of U.S. Pat. No. 4,500,626.

In the embodiments of the present invention where the image is formed by dye diffusion transfer, a dye fixing element is used along with the photosensitive element. The dye fixing element may be coated separately on a separate support from the photosensitive element or it may be coated on the same support as the photosensitive element. The relationships disclosed in column 57 of U.S. Pat. No. 4,500,626 can also be used here as the relationship between the photosensitive element and the dye fixing element and the relationship with the support and the relationship with a white reflecting layer.

The dye fixing elements preferably used in the present invention have at least one layer which contains a mordant and a binder. The mordants known in the field of photography can be used, and examples include the mordants disclosed in columns 58–59 of U.S. Pat. No. 4,500,626 and on pages 32–41 of JP-A-61-88256, and those disclosed in JP-A-62-244043 and JP-A-62-244036. Furthermore, transition metal ions may be included for chelation by the dyes which have diffused. Other methods of fixing dyes include the use of polymeric compounds which have dye accepting properties such as those disclosed in U.S. Pat. No. 4,463,079.

Auxiliary layers, such as protective layers, peeling layers, neutralizing layers, timing layers and anti-curl layers, can be established, as required, in a dye fixing element. The establishment of a protective layer is especially useful.

Moreover, in cases where thermal development is used for processing, there is no need for such a high pH value and so there is no need for the establishment of neutralizing layers and timing layers in the photosensitive elements or dye fixing elements.

High boiling point organic solvents can be used as plasticizers, slip agents or as agents for improving the peeling properties of the photosensitive element and the dye fixing element in the constituting layers of the photosensitive and dye fixing elements. In practice, use can be made of those disclosed, for example, on page 25 of JP-A-62-253159 and JP-A-62-245253.

Moreover, various silicone oils (all of the silicone oils ranging from dimethylsilicone oil to the modified silicone oils in which various organic groups have been introduced into dimethylsiloxane) can be used for the above mentioned purpose. As an example, the various modified silicone oils described in data sheet P6–18B, "modified Silicone Oils", put out by the Shinetsu Silicone Co., and especially the carboxy modified silicone (trade name X-22-3710) are effective.

Furthermore, the silicone oils disclosed in JP-A-62-215953 and JP-A-63-46449 are also effective.

Anti-color fading agents may be used in the photosensitive elements and dye fixing elements. Antioxidants, ultraviolet absorbers and certain types of metal complex can be used as anti-color fading agents.

Examples of compounds which are effective as antioxidants include chroman based compounds, coumaran based compounds, phenol based compounds (for example, hindered phenols), hydroquinone derivatives, hindered amine derivatives, and spiroindane based compounds. Furthermore, the compounds disclosed in JP-A-61-159644 are also effective.

Compounds such as benzotriazole compounds (for example, U.S. Pat. No. 3,533,794), 4-thiazolidone based compounds (for example, U.S. Pat. No. 3,352,681, benzophenone based compounds (for example, JP-A-46-2784) and the compounds disclosed, for example, in JP-A-54-48535, JP-A-62-136641 and JP-A-61-88256 can be used as ultraviolet absorbers. Furthermore, the ultraviolet absorbing polymers disclosed in JP-A-62-260152 are also effective.

The compounds disclosed, for example, in U.S. Pat. Nos. 4,241,155, columns 3–36 of U.S. Pat. No. 4,245,018, columns 3 –8 of U.S. Pat. No. 4,254,195, JP-A-62-174741, pages 27–29 of JP-A-61-88256, JP-A-63-199248 and JP-A-1-75568 and JP-A-1-74272 can be used as metal complexes.

Examples of useful anti-color fading agents have been disclosed on pages 125–137 of JP-A-62-215272.

Anti-color fading agents for preventing the fading of dyes which have been transferred to the dye fixing element may be included beforehand in the dye fixing element or they may be supplied to the dye fixing element from the outside, for instance from the photosensitive element.

The above mentioned antioxidants, ultraviolet absorbers and metal complexes may be used in combinations of each type.

Fluorescent whiteners may be used in the photosensitive and dye fixing elements. In particular, fluorescent whiteners are preferably incorporated into the dye fixing element or supplied to the dye fixing element from the outside, or from the photosensitive element, for example. As an example, the compounds disclosed, for example, in chapter 8 of volume V of *The Chemistry of Synthetic Dyes*, by K. Veenkataraman, and JP-A-61-143752, can be used. In more practical terms, use can be made, for example, of stilbene based compounds, coumarin based compounds, biphenyl based compounds, benzoxazole based compounds, naphthalimide based compounds, pyrazoline based compounds and carbostiryl based compounds.

Fluorescent whiteners can be used in combination with anti-color fading agents.

The film hardening agents disclosed, for example, in column 41 of U.S. Pat. No. 4,678,739, JP-A-59-116655, JP-A-62-245261 and JP-A-61-18942 can be used as film hardening agents in the constituting layers of the photosensitive and dye fixing elements. In more practical terms, use can be made of aldehyde based film hardening agents (formaldehyde for example), aziridine based film hardening agents, epoxy based film hardening agents

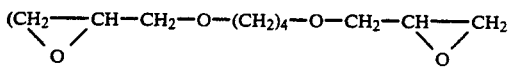

for example), vinylsulfone based film hardening agents (N,N'-ethylenebis(vinylsulfonylacetamido)ethane) for example), N-methylol based film hardening agents (dimethylol urea for example), and polymeric film hardening agents (the compounds disclosed, for example, in JP-A-62-234157).

Various surfactants can be used in the constituting layers of the photosensitive and dye fixing elements as coating aids, for improving peelability, for improving slip properties, for anti-static purposes or for accelerating development for example. Examples of surfactants have been disclosed, for example, in JP-A-62-173463 and JP-A-62-183457.

Organic fluorine compounds may be included in the constituting layers of the photosensitive and dye fixing elements with a view to improving slip properties, for anti-static purposes or for improving peeling properties, for example. Typical examples of organic fluorine compounds include the fluorine based surfactants disclosed, for example, in columns 8–17 of JP-B-57-9053, JP-A-61-20944 and JP-A-62-135826, and the oil-like fluorine based compounds such as fluorine oil and hydrophobic fluorine compounds including solid fluorine compound resins such as ethylenetetrafluoride resins.

Matting agents can be used in the photosensitive and dye fixing elements. Additionally, the silicon dioxide and polyolefin or polymethacrylate disclosed on page 29 of JP-A-61-88256, the compounds disclosed in JP-A-63-274944 and JP-A-63-274952, such as benzoguanamine resin beads, polycarbonate resin beads and AS resin beads, for example, can be used as matting agents.

Furthermore, thermal solvents, anti-foaming agents, biocides and fungicides, and colloidal silica, for example, may be included in the photosensitive and dye fixing elements. Examples of these additives have been disclosed on pages 26–32 of JP-A-61-88256.

Image forming accelerators can be used in the photosensitive elements and/or dye fixing elements. The use of image forming accelerators is especially desirable in cases where processing is carried out using thermal development. Image forming accelerators are compounds which accelerate the redox reaction of the silver salt oxidizing agents and the reducing agent, accelerate the reaction which produces the dye from the dye donating substance, which breaks down the dye or which releases a diffusible dye, and accelerate the migration of the dye to the dye fixing layer. On the basis of their physico-chemical function, these accelerators can be divided into bases or base precursors, nucleophilic compounds, high boiling point organic solvent (oils), thermal solvents, surfactants, and compounds which interact with silver or silver ion, for example. However, these groups of substances generally have a complex function and normally combine some of the above mentioned accelerating effects. Details have been disclosed in columns 38–40 of U.S. Pat. No. 4,678,739.

Base precursors are, for example, salts of a base and an organic acid which is decarboxylated by heating, or compounds which release amines by an intramolecular nucleophilic substitution reaction, a Lossen rearrangement or a Beckmann rearrangement. Examples have been disclosed, for example, in U.S. Pat. No. 4,511,493 and JP-A-62-65038.

In the systems in which thermal development and dye transfer are carried out simultaneously in the presence of a small amount of water, the base or base precursor is preferably included in the dye fixing element to ensure good storage properties for the photosensitive element.

Apart from the above, the combinations of sparingly soluble metal compounds and compounds which can take part in a complex forming reaction (known as complex forming compounds) with the metal ions from which these sparingly soluble metal compounds are formed disclosed in European Patent Laid Open 210,660 and U.S. Pat. No. 4,740,445, and the compounds which produce bases by electrolysis disclosed in JP-A-61-232451, for example, can also be used as base precursors. The former method is particularly effective. The sparingly soluble metal compound and the complex forming compound are usefully added separately to the photosensitive element and the dye fixing element.

Various development terminating agents can be used in the photosensitive elements and/or dye fixing elements of the present invention with a view to obtaining a constant image irrespective of fluctuations in the processing temperature and the processing time during development.

Here, the term "development terminator" signifies a compound which, after proper development, neutralizes the base or reacts with the base, reduces the base concentration in the film and terminates development, or a compound which interacts with silver and silver salts and thereby inhibits development. In practice, these compounds include acid precursors which release an acid on heating, electrophilic compounds which undergo substitution reactions with a base on heating, and nitrogen containing heterocyclic compounds, mercapto compounds and precursors of these compounds. Further details have been disclosed on pages 31–32 of JP-A-62-253159.

Paper and synthetic polymers (films) are generally used for the support of the photosensitive elements and dye fixing elements of the present invention. In practice, use can be made of supports comprised of poly(ethylene terephthalate), polycarbonate, poly(vinyl chloride), polystyrene, polypropylene, polyimide, cellulose derivatives (for example, triacetylcellulose) or supports wherein a pigment such as titanium oxide is included within these films, film type synthetic papers made from polypropylene, papers made from a synthetic resin, such as polyethylene, pulp and natural pulp, Yankee paper, baryta paper, coated papers (especially cast coated papers), metals, cloths and glasses for example.

These supports can be used individually, or supports which have been laminated on one side or on both sides with a synthetic polymer such as polyethylene for example can also be used.

The supports disclosed on pages 29–31 of JP-A-62-253159 can also be used.

Hydrophilic binder and a semiconductive metal oxide such as tin oxide or alumina sol, carbon black and other anti-static agents may be coated on the surface of the support.

The methods which can be used for exposing and recording an image on a photosensitive element include: (1) those in which the picture of a view or a person is taken directly using a camera for example, (2) methods in which an exposure is made though a reversal film or a negative film using a printer or an enlarger, (3) methods in which a scanning exposure of an original is made through a slit using the exposing device of a copying machine for example, (4) methods in which the exposure is made with light emitted from a light emitting diode or various types of laser, being controlled by an electrical signal in accordance with picture information, and (5) methods in which exposures are made directly or via an optical system using the output of an image display device such as a CRT, a liquid crystal display, an electro-luminescent display or a plasma display.

As indicated above, natural light, tungsten lamps, light emitting diodes, laser light sources, and CRT light sources, the light sources disclosed in column 56 of U.S. Pat. No. 4,500,626, are examples of the light sources for recording images on a photosensitive element.

Furthermore, image exposures can also be made using wave-length conversion elements in which a non-linear optical material is combined with a coherent light source such as laser light. Here, a non-linear optical material is a material which when irradiated with a strong photoelectric field such as laser light, exhibits a non-linearity between the apparent polarization and the electric field. Inorganic compounds typified by lithium niobate, potassium dihydrogen phosphate (KDP), lithium iodate and $BaB_2O_4$, and urea derivatives, nitroaniline derivatives, nitropyridine-N-oxide derivatives such as 3-methyl-4-nitropyridine-N-oxide (POM) for example, and the compounds disclosed in JP-A-61-53462 and JP-A-62-210432 are preferably used for this purpose. Any of the known embodiments of wavelength converting elements such as the single crystal optical wave guide type and the fibre type can be used.

Furthermore, the aforementioned image information may be an image signal which has been obtained using a video camera or an electronic still camera for example, a television signal as typified by the Japanese television signal specification (NTSC), an image signal obtained by dividing an original into a plurality of picture elements using a scanner for example, or an image signal which has been generated using a computer as typified by CG and CAD.

The photosensitive element and/or dye fixing element may be such that they have an electrically conductive heat generating layer as a means of heating for thermal development purposes or for the diffusion transfer of dyes by heating. In that case a transparent or opaque heat generating element as disclosed in JP-A-61-145544 can be used. Moreover, such an electrically conductive layer also functions as an anti-static layer.

Diffusion transfer photographic materials of the present invention may be processed using the so-called color diffusion transfer method in which image formation is achieved using an alkali processing composition at close to normal temperature, or they may be processed by thermal development. The various known systems can be adopted for the color diffusion transfer method.

Processing by thermal development is described in more detail below.

Thermal development is possible at temperatures of from about 50° C. to about 250° C., but heating temperatures of from about 80° C. to about 180° C. are especially useful in the thermal development process. A dye diffusion transfer process may be carried out at the same time as thermal development, or it may be carried out after the completion of the thermal development process. In the latter case, transfer is possible with heating temperatures for the transfer process within the range from the temperature in the thermal development process to room temperature, but temperatures of at least 50° C. but about 10° C. lower than the temperature during the thermal development process are preferred.

Dye transfer can be achieved by heat alone, but solvents may be used in order to promote dye migration.

Furthermore, the methods in which development and transfer are carried out simultaneously or continuously by heating in the presence of a small amount of solvent (especially water) as described in detail in JP-A-59-218443 and JP-A-61-238056 are also useful. In these methods the heating temperature is preferably at least 50° C. but the boiling point of the solvent or less and, for example, when water is used as the solvent a temperature of at least 50° C. but 100° C. or less is desirable.

Water or a basic aqueous solution which contains an inorganic alkali metal salt or an organic salt (the bases disclosed in the section on image forming accelerators can be used for the base) are examples of solvents which can be used to accelerate development and/or to transfer a diffusible dye into the dye fixing layer. Furthermore, low boiling point solvents or mixtures of low boiling point solvents and water or basic aqueous solutions, for example, can also be used. Furthermore, surfactants, anti-fogging agents, and sparingly soluble metal salts and complex forming compounds, for example, may be included in the solvent.

These solvents may be applied to the dye fixing element, to the photosensitive element or to both of these elements. The amount used should be small, being less than the amount of solvent corresponding to the maximum swelled volume of the whole coated film (in particular, less than the amount obtained on subtracting the weight of the whole coated film from the weight of the solvent corresponding to the maximum swelled volume of the whole coated film).

The method described on page 26 of JP-A-61-147244 can be used, for example, for applying the solvent to the photosensitive layer or dye fixing layer. Furthermore, the solvent can also be incorporated into the photosensitive element, the dye fixing element or both of these elements beforehand in a form in which it has been enclosed by microencapsulation.

Furthermore, methods in which a hydrophilic thermal solvent which is a solid at normal temperature but which melts at elevated temperatures is incorporated in the photosensitive element or dye fixing element can also be adopted for accelerating dye transfer. The hydrophilic thermal solvent may be incorporated into the photosensitive element or the dye fixing element, or it may be incorporated into both of these elements. The layer into which it is incorporated may be an emulsion layer, an intermediate layer, a protective layer or a dye fixing layer, but it is preferably incorporated into a dye fixing layer and/or a layer adjacent thereto.

Examples of hydrophilic thermal solvents include ureas, pyridines, amides, sulfonamides, imides, alnyles (sic), oximes and other heterocyclic compounds.

Furthermore, high boiling point organic solvents may be included in the photosensitive element and/or dye fixing element in order to accelerate dye migration.

Sometimes the material is brought into contact with a heated block or plate, sometimes the material is brought into contact with a hot plate, a hot presser, a heated roller, a halogen lamp heater or an infrared or far-infrared lamp heater for example, and sometimes the material is passed through a high temperature atmosphere as a means of heating in the development and/or transfer process.

The method by which the photosensitive element and the dye fixing element are brought together under the pressing conditions during contact and with pressure applied as disclosed on page 27 of JP-A-61-147244 can be used.

Any of the various thermal development devices can be used for processing the photographic elements of the present invention. For example, use of the devices disclosed, for example, in JP-A-59-75247, JP-A-59-177547, JP-A-59-181353, JP- A-60-18951 and JP-A-U-62-25944 is desirable. (The term "JP-A-U" as used herein signifies an "unexamined published Japanese utility model application".)

The problems mentioned at the outset have been resolved by means of a method of coating hydrophilic polymers wherein a coating liquid which contains a solution comprising a water soluble polymer of which undergoes a reversible sol/gel transformation on heating and cooling an aqueous solution, a hydrophilic organic solvent in which the said water soluble polymer is essentially insoluble and water is used. Especially, the problems are resolved by a method of coating hydrophilic polymers wherein a coating liquid which contains a solution of a water soluble polymer which has been obtained by adding water after dispersing the aforementioned water soluble polymer in the aforementioned hydrophilic organic solvent and forming a solution or by dissolving the aforementioned water soluble polymer in a mixed solution of the aforementioned hydrophilic organic solvent and water is used.

A natural macromolecular substance such as gelatin for example can be used for the water soluble polymer which undergoes a reversible sol/gel transformation on heating and cooling an aqueous solution which is used in the present invention.

All gelatins, such as acid treated gelatin, lime treated gelatin and enzyme treated gelatin for example, can be used for the gelatin, and the gelatin may be a hide gelatin or a bone (ossein) gelatin. In general, lime treated ossein gelatin is used. Lime treated ossein gelatin which has been subjected to a calcium removal process can also be used.

Furthermore, the effect of the present invention is especially pronounced when a natural macromolecular polysaccharide is used for the water soluble polymer. The natural macromolecular polysaccharides obtained by extraction and refinement from red algae disclosed in table 1 on page 21 of *Shokuhin Kogyo, Volume* 31 (1988) can be cited as natural macromolecular polysaccharides. In many cases the natural macromolecular polysaccharide originating from red algae is comprised of a mixture of various polysaccharides. In the present invention, these mixtures may be used as they are, or single highly purified material can be used.

From among the natural macromolecular polysaccharides originating from red algae, those which are especially suitable for the coating of photographic elements include agar, κ-carrageenan, λ-carrageenan, ι-carrageenan and phaeceleran. These substances can be procured as commercial products. For example, κ-carrageenan can be obtained as Taito Gelling Agent NK-4 made by the Taito Co., and a material comprising of trace amount of κ-carrageenan in λ-carrageenan can be obtained as Taito Gelling Agent MV, also made by the Taito Co.

Furthermore, natural macromolecular polysaccharides obtained by fermentation, for example "Jelan Gum" (Kelkogel, made by Dainippon Seiyaku K.K.) can also be used.

In the present invention, the water soluble polymer as described above is preferably transformed into a solution by adding water after dispersing the said water soluble polymer in a hydrophilic organic solvent in which the polymer is essentially insoluble to make a solution or by dissolving the aforementioned water soluble polymer in a mixed solution of the aforementioned hydrophilic organic solvent and water (this is referred to as a solution of a water soluble polymer of the present invention). This solution is used as a direct coating liquid or it is mixed with an aqueous solution of another water soluble polymer which has a binder forming action, and then used as a coating liquid. It is possible in this way to dissolve the water soluble polymer rapidly without forming undissolved lumps which are known as "butsu", "dama" and "mamako" for example.

The hydrophilic organic solvents which can be used for preparing the solution of a water soluble polymer of the present invention are organic solvents in which the above mentioned water soluble polymers are essentially insoluble and which can be mixed without separation with water in a form in which the water contains at least 30 wt·% of the organic solvent. Those solvents which can be removed by evaporation from the coated film in the post-coating drying process are especially desirable. Thus, organic solvents whose boiling point is 100° C. or less are preferred.

Typical examples of such hydrophilic organic solvents include alcohols (for example, methanol, ethanol, propanol, butanol), ketones (for example, acetone, methyl ethyl ketone) and mixtures of these solvents, but methanol, ethanol and methyl ethyl ketone are especially desirable.

The proportions of each component used in the preparation of a solution of a water soluble polymer of the present invention are arbitrary, but the use of generally from 0.1 to 20 parts by weight, and more desirably of from 1 to 10 parts by weight, of hydrophilic organic solvent per 1 part by weight of water soluble polymer of the present invention and of at least 10 parts by weight, and most desirably of from 10 to 100 parts by weight, of water per 1 part by weight of water soluble polymer of the present invention is preferred.

In the present invention the solution of water soluble polymer of the present invention is taken as it is or after being mixed with a solution of another water soluble polymer which has a binder forming action (for example, an aqueous gelatin solution which has been prepared in a separate procedure) as a coating liquid and this is coated on an appropriate support.

No limitation is imposed upon the method of coating which is employed in the present invention and various methods and equipment, including conventional dip coating, roller coating, reverse roll coating, air knife coating, doctor blade coating, spray coating, beads coating, extrusion coating, stretch flow coating and curtain coating methods, for example, can be used. The water soluble polymer solution is gelled by cooling the coated layer after coating and a coated layer can be obtained by subsequent drying.

The method of coating of the present invention can be applied to materials for various applications in which a water soluble polymer is used as a binder. Examples include ink jet recording papers, heat sensitive papers, heat sensitive copy papers, analytical elements for medical diagnostic purposes, plotter papers, auto-radiographic developing elements, optical filters, silver halide photosensitive materials and image receiving materials.

From among these materials, the advantageous features of the present invention are pronounced in the case of silver halide photosensitive materials and image receiving materials into which image forming substances which have diffused from a silver halide photosensitive element are transferred in a diffusion transfer system (also known as dye fixing materials), and so these applications are described below.

Silver halide photosensitive materials are materials which contain silver halides as photosensitive materials. The coating method of the present invention can be used for coating photosensitive layers and other constituting layers (for example, over-coating layers, intermediate layers, underlayers, anti-halation layers, filter layers, backing layers, anti-static layers, diffusible dye donating layers, water absorbing layers, processing agent supplying layers, electrical heat generating layers) of these photosensitive materials.

Furthermore, the method of coating of the present invention can be used for coating image receiving layers and other constituting layers (for example, over-coating layers, intermediate layers, under-layers, backing layers, electrical heat generating layers, water absorbing layers, white reflecting layers, neutralizing layers and timing layers) of image receiving materials.

Any of the silver halides silver bromide, silver iodobromide, silver iodochlorobromide, silver chlorobromide and silver chloride may be used in the photographic emulsion layers of a photographic photosensitive material to which the present invention is applied.

The silver halide grains in the photographic emulsion may be so-called regular grains which have a regular crystalline form such as a cubic, octahedral or tetradecahedral form, or they may have an irregular crystalline form such as a spherical form, or they may have crystal defects such as twinned crystal planes for example, or they may have a form which is a composite of these forms.

The size of the silver halide grains may be very small at less than about 0.1 microns, or the grains may be of a large size with a projected area diameter of up to about 10 microns. The emulsions may be mono-disperse emulsions with a narrow grain size distribution or poly-disperse emulsions with a wide grain size distribution.

The photographic emulsions used in the invention can be prepared using the methods described by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964. That is to say, acidic methods, neutral methods or ammonia methods can be used. A single sided mixing method, a simultaneous mixing method, or a combination of these methods may be used for the system by which the soluble halogen salt is reacted with the soluble silver salt. Methods in which the grains are formed in the presence of excess silver ion (so-called reverse mixing methods) can also be used. The method in which the pAg value in the liquid phase in which the silver halide is being formed is held constant, the so-called controlled double jet method, can also be used as one type of simultaneous mixing method. Silver halide emulsions with a regular crystalline form and an almost uniform grain size can be obtained using this method.

Mixtures of two or more types of silver halide emulsion which have been prepared separately may be used.

Silver halide emulsions comprised of the aforementioned regular grains can be obtained by adjusting the pAg and pH values during grain formation. Details have been disclosed, for example, on pages 159–165 of *Photographic Science and Engineering*, Vol. 6, 1962, on pages 242–251 of *Journal of Photographic Science*, Vol. 12, 1964, and in U.S. Pat. No. 3,655,394 and British Patent 1,413,748.

Mono-disperse emulsions have been disclosed, for example, in JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394 and British Patent 1,413,748.

Furthermore, tabular grains of which the aspect ratio is at least 5 can also be used in this invention. Tabular grains can be prepared easily using the methods described, for example, by Cleve in *Photography Theory and Practice* page 131, (1930), by Gutoff in *Photographic Science and Engineering*, Vol. 14, pages 248–257 (1970), and in U.S. Pat. Nos. 4,434,226, 4,414,310, 4,433,048 and 4,439,520, and in British Patent 2,112,157. There are advantages in those cases where tabular grains are used in that the covering power is increased and in that the color sensitization efficiency with sensitizing dyes is increased. Details have been given in the previously cited U.S. Pat. No. 4,434,226.

The crystal structure may be uniform, or it may take a form comprising inner and outer parts which have different halogen compositions and a layer structure may be formed. Such emulsion grains have been disclosed, for example, in British Patent 1,027,146, U.S. Pat. Nos. 3,505,068 and 4,444,877, and in JP-A-60-143331. Furthermore, silver halides which have different compositions may be joined epitaxially, or they may be joined with compounds other than silver halides, such as silver thiocyanate or lead oxide. Such emulsion grains have been disclosed, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

Mixtures of grains of various crystalline forms may be used.

Silver halide solvents are useful for accelerating ripening. For example, it is known that ripening is accelerated with the presence of excess halogen ion in the reactor. Consequently, it is clear that ripening can be accelerated simply by introducing a solution of halide into the reactor. Other ripening agents can be used, and these ripening agents can be combined in total with the dispersion medium in the reactor prior to the addition of the silver and halide or they can be introduced into the reactor together with the addition of one or two or more than two of the halides, silver salts and deflocculating agents. In another embodiment, the ripening agents are introduced independently at the halide or silver salt addition stage.

Ammonia or amine compounds, and thiocyanates, for example alkali metal thiocyanates and ammonium thiocyanate, can be used as ripening agents as well as halogen ions. The use of thiocyanate ripening agents has been described in U.S. Pat. Nos. 2,222,264, 2,448,534 and 3,320,069. Furthermore, the commonly used thioether ripening agents such as those disclosed in U.S. Pat.

Nos. 3,271,157, 3,574,628 and 3,737,313 can also be used. Alternatively, thione compounds such as those disclosed in JP-A-53-82408 and JP-A-53-144319 can also be used.

The nature of the silver halide grains can be controlled by the presence of various compounds during the silver halide precipitation and formation process. Compounds of this type may be present in the reactor initially or they can be added along with the addition of one, two or more than two salts in accordance with the usual methods. The characteristics of the silver halide can be controlled by the presence during the silver halide precipitation and formation process of compounds of copper, iridium, lead, bismuth, cadmium, zinc (chalcogen compounds of sulfur, selenium, tellurium for example), and compounds of gold and group VII precious metals, as disclosed in U.S. Pat. Nos. 2,448,060, 2,628,167, 3,737,313 and 3,772,031, and in *Research Disclosure*, volume 134, June 1975, number 13452. Internal reduction sensitization of the grains can be achieved during the precipitation and formation process of silver halide emulsions as disclosed in JP-B-58-1410 and by Moisar et al. in *Journal of Photographic Science*, Volume 25, 1977, pages 19–27.

The silver halide emulsions are generally sensitized chemically. Chemical sensitization can be achieved using active gelatin as disclosed on pages 67–76 of *The Theory of the Photographic Process*, by T.H. James, 4th edition, Macmillan, 1977, and by using sulfur, selenium, tellurium, gold, platinum, palladium, iridium or a combination of these sensitizing agents at pAg 5–10, pH 5–8 and at a temperature of from 30° C. to 80° C., as disclosed in *Research Disclosure*, volume 120, April 1974, No. 12008, *ibid* volume 34, June 1975, No. 13452, U.S. Pat. Nos. 2,642,361, 3,297,446, 3,772,031, 3,857,711, 3,901,714, 4,266,018 and 3,904,415, and British Patent 1,315,755. Chemical sensitization is carried out optimally in the presence of gold compounds and thiocyanate compounds, and in the presence of the sulfur containing compounds disclosed in U.S. Pat. Nos. 3,857,711, 4,266,018 and 4,054,457 or sulfur containing compounds such as hypo, thiourea based compounds and rhodanine based compounds for example. Chemical sensitization can be carried out in the presence of chemical sensitization promotors. The compounds known as agents for inhibiting fogging in the chemical sensitization process and increasing photographic speed, such as azaindenes, azapyridazines and azapyrimidines, are used as chemical sensitization promotors. Examples of chemical sensitization promotor improvers have been disclosed in U.S. Pat. Nos. 2,131,038, 3,411,914 and 3,554,757, JP-A-58-126526 and the aforementioned book *Photographic Emulsion Chemistry*, by Duffin, pages 138–143. Reduction sensitization can be achieved using hydrogen, for example, as disclosed in U.S. Pat. Nos. 3,891,446 and 3,984,249, or using stannous chloride, thiourea dioxide, polyamine or reducing agents of this type, and reduction sensitization by treatment at a low pAg value (for example less than 5) and/or a high pH value (for example greater than 8), as disclosed in U.S. Pat. Nos. 2,518,698, 2,743,182 and 2,743,183 can be carried out in addition to, or in place of, chemical sensitization. Furthermore, color sensitivity can also be improved using the chemical sensitization methods disclosed in U.S. Pat. Nos. 3,917,485 and 3,966,476.

The photosensitive materials of the present invention may contain one or more types of surfactant as coating promotors, for anti-static purposes, for improving slip properties, for emulsification and dispersion purposes, for preventing the occurrence of sticking and for improving photographic characteristics (for example, for accelerating development, increasing contrast and increasing photographic speed) for example.

The silver halide photographic emulsions used in the invention may be spectrally sensitized using cyanine dyes or by other means. The dyes which can be used include cyanine dyes, merocyanine dyes, complex cyanine dyes, complex merocyanine dyes, holopolar cyanine dyes, hemi-cyanine dyes, styryl dyes and hemioxonol dyes. Dyes classified as cyanine dyes, merocyanine dyes and complex merocyanine dyes are especially useful dyes. All of the nuclei normally used in cyanine dyes can be used for the basic heterocyclic nuclei in these dyes. That is to say, the nucleus may be a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; a nucleus in which one of these nuclei is fused with an aliphatic hydrocarbon ring, or a nucleus in which one of these nuclei is fused with an aromatic hydrocarbyl ring, which is to say an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus for example. These nuclei may be substituted on the carbon atoms.

The nucleus which has a ketomethylene structure in the merocyanine dyes or complex merocyanine dyes may be a five or six membered heterocyclic nucleus, for example a pyrazolin-5-one nucleus, a thiohydantoin nucleus, a 2-thio-oxazolidin-2,4-dione nucleus, a thiazolidin-2,4-dione nucleus, a rhodanine nucleus or a thiobarbituric acid nucleus.

These sensitizing dyes may be used individually or they may be used in combinations, and combinations of sensitizing dyes are often used in particular with the intention of achieving super-sensitization. Substances which exhibit super-sensitization, being dyes which themselves have no spectral sensitizing action or substances which essentially do not absorb visible light can be included in the emulsion together with the sensitizing dyes. For example, substituted aminostilbene compounds with a nitrogen containing heterocyclic group (for example, those disclosed in U.S. Pat. Nos. 2,933,390 and 3,635,721), aromatic organic acid/formaldehyde condensates (for example, those disclosed in U.S. Pat. No. 3,743,510), and cadmium salts and azaindene compounds, for example, may be included. The combinations disclosed in U.S. Pat. Nos. 3,615,613, 3,615,641, 3,617,295 and 3,635,721 are especially useful.

Various compounds can be included in the material of the present invention with a view, for example, to preventing the occurrence of fogging during the manufacture, storage or photographic processing of the photosensitive material, or with a view to stabilizing photographic performance. Thus, many compounds which are known as anti-fogging agents or stabilizers, such as azoles, for example benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mecaptotetrazoles (especially 1-phenyl-5-mercaptotetrazole); mercaptopyrimidines; mercaptotriazines; for example thioketo compounds such as oxazolinethione; azaindenes, for example triazaindenes, tetra-azaindenes (especially 4-hydroxy substituted (1,3,3a,7-tetra-azaindenes) and penta-azaindenes; benzenethiosulfonic acid; benzenesulfinic acid and benzenesulfonic acid amide, for example, can be added.

Gelatin is useful as a binding agent or protective colloid which can be used in the emulsion layers or intermediate layers of the photosensitive materials of the present invention, but other hydrophilic colloids can also be used. For example, gelatin derivatives, graft polymers of other polymers with gelatin, proteins such as albumin and casein, cellulose derivatives such as hydroxyethylcellulose, carboxymethylcellulose and cellulose sulfate esters, sodium alginate and sugar derivatives such as starch derivatives, and various synthetic hydrophilic polymeric materials, for example homopolymers or copolymers such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, can be used.

As well as general purpose lime treated gelatins, acid treated gelatins and enzyme treated gelatins, as described in *Bull. Soc. Sci. Phot. Japan*, No. 16, page 30 (1966) may be used for the gelatin. Gelatin hydrolyzates can also be used.

The photosensitive materials of the present invention may contain inorganic or organic film hardening agents in any of the hydrophilic colloid layers which form the photographic photosensitive layer or the backing layer. Chromium salts, aldehydes (for example, formaldehyde, glyoxal, glutaraldehyde), and N-methylol compounds (for example, dimethylolurea) can be cited as actual examples of such compounds. The use of active halogen compounds (for example, 2,4-dichloro-6-hydroxy-1,3,5-triazine and its sodium salt), and active vinyl compounds (for example, 1,3-bisvinylsulfonyl-2-propanol, 1,2-bis(vinylsulfonylacetamido)ethane or vinyl based polymers which have vinyl groups in side chains) is desirable for rapidly hardening the hydrophilic colloids such as gelatin and providing stable photographic characteristics. N-Carbamoylpyridinium salts (for example, (1-morpholinocarbonyl-3-pyridinio)methanesulfonate), and haloamidinium salts (for example, 1-(1-chloro-1-pyridinomethylene)pyrrolidinium 2-naphthalenesulfonate) are also excellent for providing rapid hardening rates.

The photographic emulsion layers and other layers in the photographic photosensitive materials of the present invention can be coated onto a flexible support such as a plastic film, paper or cloth for example, or onto a rigid support such as glass, porcelain or metal for example, of the type normally used for photographic photosensitive materials. Useful flexible supports include, for example, films made of semi-synthetic or synthetic polymers, such as cellulose nitrate, cellulose acetate, cellulose acetate butyrate, polystyrene, poly(vinyl chloride), poly(ethylene terephthalate) or polycarbonate for example, and papers which have been coated or laminated with a baryta layer or an α-olefin polymer (for example polyethylene, polypropylene, ethylene/butene copolymer). The support may be colored using dyes or pigments. It may also be colored black for light shielding purposes. The surface of the support is usually undercoated to improve adhesion with the photographic emulsion layer for example. The surface of the support may be subjected to a glow discharge treatment, a corona discharge treatment, ultraviolet irradiation or a flame treatment, for example, before or after the undercoating treatment.

The present invention can be applied to various color and black and white photosensitive materials. Typical applications include color negative films for general and cinematographic purposes, color reversal films for slides and television purposes, color papers, color positive films and color reversal papers, color diffusion transfer type photosensitive materials and heat developable type color photosensitive materials. The invention can also be applied to black and white photosensitive materials such as those intended for X-ray purposes in which the tri-color coupler mixtures disclosed, for example, in *Research Disclosure*, No. 17123 (July 1978) are used, or in which the black colored couplers disclosed, for example, in U.S. Pat. No. 4,126,461 and British Patent 2,102,136 are used. The invention can also be applied to printing plate making films, such as lith films and scanner films, to X-ray films intended for use in direct or indirect medical applications or industrial applications, camera black and white negative films, black and white printing papers, microfilms for COM or general purposes, silver salt diffusion transfer type photosensitive materials and print-out type photosensitive materials.

Various color couplers can be used in those cases where the present invention is applied to coupler type color photosensitive materials. Color couplers are compounds which can form dyes by means of a coupling reaction with the oxidized form of a primary aromatic amine developing agent. Typical examples of useful color couplers include naphthol or phenol based compounds, pyrazolone or pyrazoloazole based compounds, and open chain or heterocyclic ketomethylene compounds. Examples of these cyan, magenta and yellow couplers which can be used in the invention include the compounds disclosed in the patents cited in *Research Disclosure* 17643 (December 1978), section VII-D, and *ibid*, No. 18717 (published 1979).

The color couplers which are incorporated in the photosensitive material are preferably rendered non-diffusible by having ballast groups or by polymerization. Two-equivalent color couplers which are substituted with a coupling leaving group are preferable to the four-equivalent couplers which have a hydrogen atom at the coupling active site in that they enable the amount of coated silver to be reduced. Moreover, couplers of which the colored dye has a suitable degree of diffusibility, non-color forming couplers, or DIR couplers which release development inhibitors as the coupling reaction proceeds or couplers which release development accelerators as the coupling reaction proceeds, can also be used.

The oil protected type acylacetamide based couplers are typical of the yellow couplers which can be used in the present invention. Examples have been disclosed, for example, in U.S. Pat. Nos. 2,407,210, 2,875,057 and 3,265,506. The use of two-equivalent yellow couplers is preferred in the present invention. Typical examples include the oxygen atom elimination-type yellow couplers disclosed, for example, in U.S. Pat. Nos. 3,408,194, 3,447,928, 3,933,501 and 4,022,620, and the nitrogen atom elimination-type yellow couplers disclosed, for example, in JP-B-58-10739, U.S. Pat. Nos. 4,401,752 and 4,326,024, RD 18053 (April 1979), British Patent 1,425,020, and West German Patent Application Laid Open Nos. 2,219,917, 2,261,361, 2,329,587 and 2,433,812. Moreover, α-pivaloylacetanilide based couplers provide colored dyes which have excellent fastness, especially light fastness, while α-benzoylacetanilide based couplers provide high color densities.

Oil protected type indazolone based or cyanoacetyl based, and preferably 5-pyrazolone based and pyrazoloazole, for example pyrazolotriazole, based couplers can be cited as magenta couplers which can be used in the present invention. The 5-pyrazolone based couplers which have an arylamino group or an acylamino group substituted in the 3-position are preferred from the point of view of the hue of the colored dye and the color density. Typical examples have been disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 and the arylthio groups disclosed in U.S. Pat. No. 4,351,897 are especially desirable as leaving groups for two-equivalent 5-pyrazolone based couplers. Furthermore, the 5-pyrazolone based couplers which have ballast groups disclosed in European Patent 73,636 provide high color densities.

The pyrazolobenzimidazoles disclosed in U.S. Pat. No. 3,061,432, and preferably the pyrazolo[5,1-c][1,2,4]triazoles disclosed in U.S. Pat. No. 3,725,067, the pyrazolotetrazoles disclosed in *Research Disclosure* 24220 (June 1984) and JP-A-60-33552, and the pyrazolopyrazoles disclosed in *Research Disclosure* 24230 (June 1984) and JP-A-60-43659 can be cited as pyrazoloazole based couplers. The imidazo[1,2-b]pyrazoles disclosed in U.S. Pat. No. 4,500,630 are preferred in view of the slight absorbance on the yellow side and the light fastness of the colored dye. The pyrazolo[1,5-b][1,2,4]-triazoles disclosed in U.S. Pat. No. 4,540,654 are especially desirable in this respect.

The oil protected-type naphthol based and phenol based couplers are cyan couplers which can be used in the present invention. Typical examples include the naphthol based couplers disclosed in U.S. Pat. No. 2,474,293, and the oxygen atom elimination-type two-equivalent naphthol based couplers disclosed in U.S. Pat. Nos. 4,052,212, 4,146,396, 4,228,233 and 4,296,200 are preferred. Furthermore, examples of phenol based couplers have been disclosed, for example, in U.S. Pat. Nos. 2,369,929, 2,801,171, 2,772,162 and 2,895,826. The use of cyan couplers which are fast to moisture and temperature are preferred in this invention. Typical examples of such couplers include the phenol based cyan couplers which have an alkyl groups comprising an ethyl or larger group in the meta position of the phenol ring disclosed in U.S. Pat. No. 3,772,002, the 2,5-diacylamino substituted phenol based couplers disclosed, for example, in U.S. Pat. Nos. 2,772,162, 3,758,308, 4,126,396, 4,334,011 and 4,327,173, West German Patent Laid Open 3,329,729 and European Patent 121,365, and the phenol based couplers which have a phenylureido group in the 2-position and an acylamino group in the 5-position disclosed, for example, in U.S. Pat. Nos. 3,446,622, 4,333,999, 4,451,559 and 4,427,767. The cyan couplers which have a sulfonamido group or an amido group for example substituted in the 5-position of the naphthol ring disclosed in Japanese Patent Application Nos. 59-93605, 59-264277 and 59-268135 also provide color images which have superior fastness and their use is preferred in the present invention.

The conjoint use of colored couplers for correcting the unwanted absorptions on the short wavelength side of the dyes formed from magenta and cyan couplers is preferred in camera color negative sensitive materials. The yellow colored magenta couplers disclosed, for example; in U.S. Pat. No. 4,163,670 and JP-B-57-39413 or the magenta colored cyan couplers disclosed, for example, in U.S. Pat. Nos. 4,004,929 and 4,138,258 and British Patent 1,146,368 can be cited as typical examples.

Graininess can be improved by the conjoint use of couplers for which the resulting colored dyes have a suitable degree of diffusibility. Examples of blurring couplers of this type include the magenta couplers disclosed in U.S. Pat. No. 4,366,237 and British Patent 2,125,570, and the yellow, magenta and cyan couplers disclosed in European Patent 96,570 and West German Patent Application Laid Open 3,234,533.

The dye forming couplers and the special couplers above mentioned can take the form of dimers or larger polymers. Typical examples of polymerized dye forming couplers have been disclosed in U.S. Pat. Nos. 3,451,820 and 4,080,211. Examples of polymerized magenta couplers have been disclosed in British Patent 2,102,173, U.S. Pat. No. 4,367,282, and Japanese Patent Application Nos. 60-75041 and 60-113596.

Two or more of the various types of coupler used in this present invention can be used conjointly in a layer of the same color sensitivity, and the same compound can be introduced into two or more different layers, in order to satisfy the characteristics required of the photosensitive material.

The couplers can be introduced into a photosensitive material using a variety of known methods of dispersion, for example using the solid dispersion method or the alkali dispersion method, preferably using the latex dispersion method, and most desirably using the oil in water dispersion method for example. In the oil in water dispersion method, after dissolution in either a high boiling point organic solvent having a boiling point at least 175° C. or a so-called auxiliary solvent having a low boiling point or in a mixture of such solvents, the solution is finely dispersed in water or an aqueous medium such as an aqueous gelatin solution for example in the presence of a surfactant. Examples of high boiling point organic solvents have been disclosed, for example, in U.S. Pat. No. 2,322,027. The dispersion may be accompanied by a phase reversal and, where required, the auxiliary solvent may be reduced or removed by evaporation, noodle washing or ultrafiltration before the dispersion is used for coating.

Examples of high boiling point solvents include phthalic acid esters (for example, dibutyl phthalate, dicyclohexyl phthalate, di-2-ethylhexyl phthalate, decyl phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tri-dodecyl phosphate, tri-butoxyethyl phosphate, tri-chloropropyl phosphate, di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N-tetradecylpyrrolidone), alcohols or phenols (for example, iso-stearyl alcohol, 2,4-di-tert-amylphenol), aliphatic carboxylic acid esters (for example, dioctyl azelate, glycerol tributyrate, iso-stearyl lactate, trioctyl citrate), aniline derivatives (for example, N,N-dibutyl-2-butoxy-5-tert-octylaniline) and hydrocarbons (for example, paraffin, dodecylbenzene, diisopropylnaphthalene). Furthermore, organic solvents which have a boiling point above about 30° C., and preferably of at least 50°

C., but below about 160° C., can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

Examples of the processes and effects of the latex dispersion method and of latexes for loading purposes have been disclosed, for example, in U.S. Pat. No. 4,199,363 and West German Patent Application (OLS) Nos. 2,541,274 and 2,541,230.

Various known photographically useful additives which can be used in this present invention have been disclosed in the aforementioned *Research Disclosure* 17643, pages 23–28 and *ibid* 18716, pages 648–651. These types of additive and the locations of these disclosures are indicated in detail in the table below.

| Type of Additive | RD 17643 | RD 18716 |
|---|---|---|
| 1. Chemical sensitizers | Page 23 | Page 648, right col. |
| 2. Speed increasing agents | | Page 648, right col. |
| 3. Spectral sensitizers and Super-sensitizers | Pages 23–24 | Pages 648 right col. to 649 right col. |
| 4. Whiteners | Page 24 | |
| 5. Anti-foggants and Stabilizers | Pages 24–25 | Page 649, right col. |
| 6. Light absorbers, filter dyes and UV absorbers | Pages 25–26 | Pages 649, right col. to 650, left col. |
| 7. Anti-staining agents | Page 25, right col. | Page 650, left - right cols. |
| 8. Dye image stabilizers | Page 25 | |
| 9. Film hardening agents | Page 26 | Page 651, left col. |
| 10. Binders | Page 26 | Page 651, left col. |
| 11. Plasticizers, lubricants | Page 27 | Page 650, right col. |
| 12. Coating promotors, Surfactants | Pages 26–27 | Page 650, right col. |
| 13. Anti-static agents | Page 27 | Page 650, right col. |

All of the known methods can be used for photographic processing of photosensitive materials of this present invention and known processing baths can be used. Furthermore, a processing temperature is generally selected between 18° C. and 50° C., but the processing temperature may be lower than 18° C. or in excess of 50° C. Development processing in which a silver image is formed (black and white photographic processing) or color photographic processing comprised of a development process in which a dye image is formed can be used, as required.

Known developing agents such as dihydroxybenzenes (for example, hydroquinone), 3-pyrazolidones (for example, 1-phenyl-3-pyrazolidone) and aminophenols (for example, N-methyl-p-aminophenol) can be used individually or in combination in a black and white developer.

A color developer is comprised of an alkaline aqueous solution which contains a color developing agent. The known primary aromatic amine developing agents such as the phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline) can be used as the color developing agent.

Those developing agents disclosed on pages 226–229 of *Photographic Processing Chemistry* by L.F.A. Mason (Focal Press, 1966), U.S. Pat. Nos. 2,193,015 and 2,592,364, and JP-A-48-64933 can also be used.

The developers can also contain pH buffers such as alkali metal sulfites, carbonates, borates and phosphates, and development inhibitors or anti-foggants such as bromide, iodide and organic anti-foggants other than the compounds of this present invention. They may also contain, as required, hard water softening agents, preservatives such as hydroxylamine, organic solvents such as benzyl alcohol and diethyleneglycol, development accelerators such as polyethyleneglycol, quaternary ammonium salts and amines, dye forming couplers, competitive couplers, fogging agents such as sodium borohydride, auxiliary developing agents such as 1-phenyl-3-pyrazolidone, thickeners, the polycarboxylic acid based chelating agents disclosed in U.S. Pat. No. 4,083,723 and the antioxidants disclosed in West German Patent Laid Open (OLS) 2,622,950 for example.

In the case of color photographic processing, the color developed photographic photosensitive material is generally subjected to a bleaching process. The bleaching process may be carried out at the same time as the fixing process or it may be carried out separately. Compounds of multi-valent metals, such as iron(III), cobalt(III), chromium(VI) and copper(II), peracids, quinones, and nitroso compounds, for example, can be used as bleaching agents. Thus, ferricyanide, dichromate, organic complex salts of iron(III) or cobalt(III), for example complex salts with aminopolycarboxylic acids such as ethylenediamine tetra-acetic acid, nitrilotriacetic acid and 1,3-diamino-2-propanol tetra-acetic acid, complex salts with organic acids such as citric acid, tartaric acid and malic acid; persulfate; permanganate; and nitrosophenol, for example, can be used as bleaching agents. Among these materials, potassium ferricyanide, ethylenediamine tetra-acetic acid iron(III) complex salts and 1,3-diaminopropane tetra-acetic acid iron(III) sodium salt and ethylene diamine tetra-acetic acid iron(III) ammonium salt are especially useful. Ethylenediamine tetra-acetic acid iron(III) complex salts are useful in both independent bleach baths and single bath bleach-fix baths.

The bleaching accelerators disclosed, for example, in U.S. Pat. Nos. 3,042,520 and 3,241,966, JP-B-45-8506 and JP-B-45-8836, the thiol compounds disclosed in JP-A-53-65732 and various other additives can also be added to the bleach and bleach-fix baths.

The water washing process is in some cases carried out in a single tank, but it is often carried out using a multi-stage counter-flow water washing system with two or more tanks. The amount of water used in the washing process can be determined arbitrarily as required in accordance with the type of color photosensitive material, but it can also be calculated using the method described by S.R. Goldwasser in "Water Flow Rates in Immersion Washing of Motion Picture Film", published on pages 248–253 of *Journal of Motion Picture and Television Engineering*, volume 64 (May 1955) for example.

Problems arise with the occurrence of bacteria and fungi when economies are made with the amount of washing water, and in response to these problems the process can be carried out with washing water in which the calcium and magnesium levels have been reduced as disclosed in Japanese Patent Application No. 61-131632, or with the addition of biocides and fungicides, for example the compounds disclosed in *J. Antibact. Antifunc. Agents*, Volume 11, No. 5, pages 207–223 (1983) and the compounds disclosed in *The Chemistry of Biocides and Fungicides* by Horiguchi. Furthermore, chelating agents such as ethylenediamine tetra-acetic acid and diethylenetriamine penta-acetic acid can also be added as hard water softening agents.

When economizing on the amount of water washing water, the amount of water used is generally from 100 ml to 2000 ml per square meter of color photosensitive material, but the use of from 200 ml to 1000 ml is preferred from the viewpoints of both the stability of the colored image and the water economy.

The pH value in the washing process is generally within the range from 5 to 9.

When photosensitive materials of this present invention are applied in the color diffusion photographic method, they can have a film unit construction of the peel apart type or of the unified (integrated) type as disclosed in JP-B-46-16356, JP-B-48-33697, JP-A-50-13040 and U.S. Pat. No. 1,330,524, or of the type where peeling apart is unnecessary as disclosed in JP-A-57-119345.

In any of the embodiments mentioned above, the use of a polymeric acid layer which is protected by a neutralizing timing layer is useful for widening the permissible processing temperature latitude. In the case of color diffusion transfer methods, these may be added to any layer in the sensitive material, or they may be sealed into the processing liquid container as a developer component.

Moreover, combinations of at least three silver halide emulsion layers which are photosensitive to different spectral regions are used in order to obtain a wide range of colors in the chromaticity diagram using the three primary colors yellow, magenta and cyan. For example, combinations of blue, green and red sensitive layers, and combinations of green, red and infrared sensitive layer can be used. The photosensitive layers can be arranged in the various orders known for color photographic materials. Furthermore, each of these photosensitive layers may be divided into two or more layers as required.

In cases where the coating methods of the present invention are applied to diffusion transfer photographic materials these are the same as described above.

EXAMPLE 1

[I] Preparation of a Photosensitive Element

(A) Photosensitive Silver Halide Emulsion (For the Red Sensitive Emulsion Layer)

Solutions (I) and (II) indicated below (Table 1) were added simultaneously at an even flow rate over a period of 30 minutes to a thoroughly agitated aqueous gelatin solution (a solution obtained by adding 20 grams of gelatin, 0.3 gram of potassium bromide, 6 grams of sodium chloride and 30 mg of reagent A indicated below to 800 ml of water and maintaining at a temperature of 50° C.). Subsequently, solutions (III) and (IV) indicated below (Table 1) were added simultaneously over a period of 30 minutes. Furthermore, the dye solution of Table 2 was added over a period of 20 minutes starting 3 minutes after the commencement of the addition of solutions (III) and (IV).

After washing with water and de-salting, 22 grams of lime treated ossein gelatin was added and, after adjustment to pH 6.2 and pAg 7.7, sodium thiosulfate and 4-hydroxy-6-methyl-1,3,3a,7-tetra-azaindene and chloroauric acid were added and the mixture was chemically sensitized optimally at 60° C. A mono-disperse cubic silver chlorobromide emulsion of average grain size 0.38 μ was obtained in this way. The recovery was 635 grams.

TABLE 1

| | Solution (I) in Water 200 ml | Solution (II) in Water 200 ml | Solution (III) in Water 200 ml | Solution (IV) in Water 200 ml |
|---|---|---|---|---|
| $AgNO_3$ | 50 grams | — | 50 grams | — |
| KBr | — | 28 grams | — | 35 grams |
| NaCl | — | 3.4 grams | — | — |

Reagent A

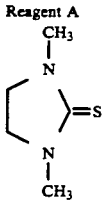

TABLE 2

67 mg

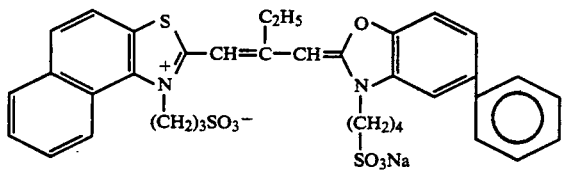

133 mg

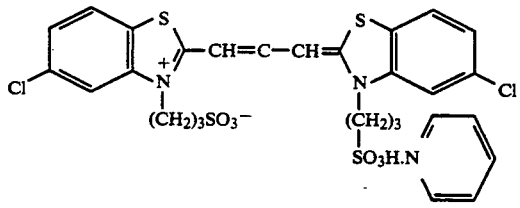

Methanol 100 mg

(B) Green Sensitive Layer Emulsion

Solution (I) and solution (II) shown in Table 4 were added over a period of 30 minutes to a thoroughly agitated aqueous gelatin solution (Table 3) which was being maintained at 50° C. Next, solution (III) and solution (IV) shown in Table 4 were added aver a period of 30 minutes and the dye solution shown in Table 5 was added 1 minute after completion of this addition.

TABLE 3

| | |
|---|---|
| Gelatin | 20 grams |
| NaCl | 6 grams |
| KBr | 0.3 gram |
| Reagent A | 0.015 gram |
| $H_2O$ | 730 ml |

TABLE 4

| | Solution (I) in Water 200 ml | Solution (II) in Water 200 ml | Solution (III) in Water 200 ml | Solution (IV) in Water 200 ml |
|---|---|---|---|---|
| $AgNO_3$ | 50 grams | — | 50 grams | — |
| KBr | — | 21 grams | — | 28 grams |
| NaCl | — | 6.9 grams | — | 3.5 grams |

TABLE 5

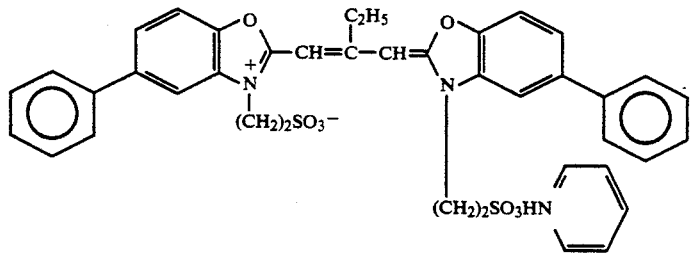

0.23 g

Methanol 154 ml

After washing with water and de-salting, 20 grams of gelatin was added, the pH and pAg values were adjusted and chemical sensitization was carried out optimally using triethylthiourea, chloroauric acid and 4-hydroxy-6-methyl-1,3,3a,7-tetra-azaindene.

The emulsion obtained was a mono-disperse cubic emulsion of average grain size 0.40 μ and the recovery was 630 grams.

(C) Blue Sensitive Layer Emulsion

Solution (I) and solution (II) indicated below (Table 6-1) were added simultaneously over a period of 30 minutes to a thoroughly agitated aqueous gelatin solution (obtained by adding 20 grams of gelatin, 3 grams of potassium bromide, 0.03 gram of reagent A and 0.25 gram of $HO(CH_2)_2S(CH_2)_2S(CH_2)_2OH$ to 800 cc of water and maintaining at 50° C.). Subsequently, solution (III) and solution (IV) indicated below (Table 6-1) were added simultaneously over a period of 20 minutes. Furthermore, the dye solution of Table 6-2 was added over a period of 18 minutes starting 5 minutes after the commencement of the addition of solution (III).

After washing with water and desalting, 20 grams of lime treated ossein gelatin was added and, after adjusting to pH 6.2 and pAg 8.5, sodium thiosulfate and 4-hydroxy-6-methyl-1,3,3a,7-tetra-azaindene and chloroauric acid were added, and the mixture was chemically sensitized optimally. Six hundred grams of a mono-disperse cubic silver chlorobromide emulsion of average grain size 0.40 μ was obtained in this way.

TABLE 6-1

| | Solution (I) in Water 180 ml | Solution (II) in Water 180 ml | Solution (III) in Water 350 ml | Solution (IV) in Water 350 ml |
|---|---|---|---|---|
| $AgNO_3$ | 30 grams | — | 70 grams | — |
| KBr | — | 17.8 grams | — | 49 grams |
| NaCl | — | 1.6 grams | — | — |

TABLE 6-2

180 mg

TABLE 6-2-continued

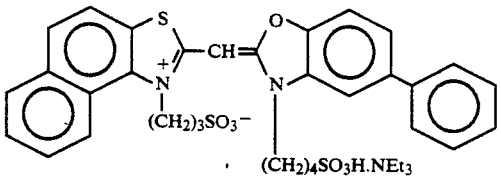

60 mg

Methanol 160 mg

The method of preparation of the zinc hydroxide dispersion is described below.

Zinc hydroxide of an average particle size of 0.2 μm (12.5 grams), 0.1 gram of poly(sodium acrylate) and 1 gram of carboxymethylcellulose as a dispersant were added to 100 ml of 4% aqueous gelatin solution and pulverized for 30 minutes using glass beads of an average diameter 0.75 mm in a mill. The glass beads were then removed and a dispersion of zinc hydroxide was obtained.

The method of preparation of the active carbon dispersion is described below.

Active carbon powder (special reagent grade, 2.5 grams) made by the Wako Pure Drug Co. and 0.25 gram of polyethylene glycol nonylphenyl ether and 1 gram of Temol N made by the Kao Soap Co. as a dispersant were added to 100 ml of 5% aqueous gelatin solution and pulverized for 120 minutes using glass beads of average diameter 0.75 mm in a mill. The glass beads were then removed and a dispersion of active carbon of an average particle size 0.5 μ was obtained.

The method of preparation of the dispersion of electron transfer agent is described below.

The electron transfer agent (10) indicated below (10 grams), 0.5 gram of the anionic surfactant indicated below and 0.5 gram of polyethyleneglycol nonylphenyl ether as dispersant were added to a 5% aqueous gelatin solution and pulverized for 60 minutes using glass beads of an average diameter 0.75 mm in a mill. The glass beads were then removed, and a dispersion of an electron transfer agent of average particle size 0.3 μ was obtained.

Electron Transfer Agent 10

-continued

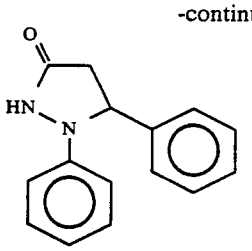

Anionic Surfactant $$NaO_3S-\underset{}{\overset{CH_2COOCH_2CH(C_2H_5)C_4H_9}{\overset{|}{C}}}HCOOCH_2CH(C_2H_5)C_4H_9$$

The method of preparation of gelatin dispersions of dye donating compounds is described below.

The yellow magenta and cyan formulations are shown in Table 7, and these were added to 50 ml of ethyl acetate in each case and heated to about 60° C. and dissolved to provide uniform solutions. The solution was then mixed with agitation with 100 ml of 10% aqueous lime treated gelatin solution, 0.6 gram of sodium dodecylbenzenesulfonate and 50 ml of water, and then dispersed at 10000 rpm for 10 minutes in a homogenizer. The dispersion obtained was referred to as a gelatin dispersion of the dye donating compound.

TABLE 7

| | Yellow | Magenta | Cyan |
|---|---|---|---|
| Dye donating compound indicated below | (1) 13 grams | (2) 15.5 grams | (3) 16.6 grams |
| Electron donor (1) indicated below | 10.2 grams | 8.6 grams | 8.1 grams |
| High boiling point solvent (2) indicated below | 6.5 grams | 7.8 grams | 8.3 grams |
| Electron transfer agent precursor (3) indicated below | 0.4 gram | 0.7 gram | 0.7 gram |
| Compound (1) indicated below | 3.9 grams | — | — |

Dye Donating Compound (1)

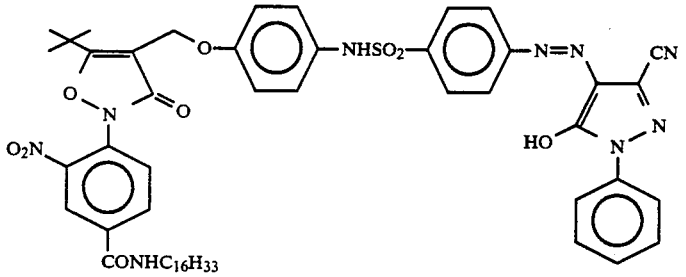

Dye Donating Compound (2)

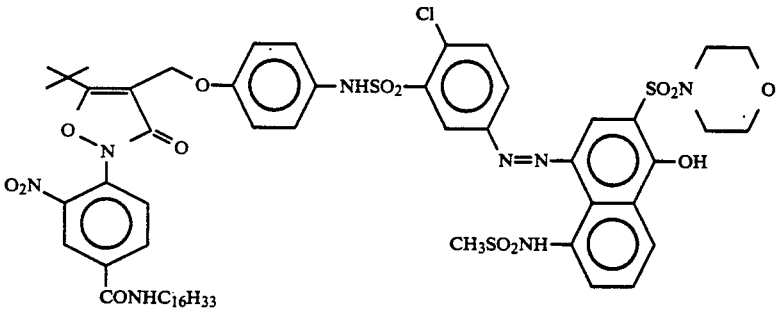

Dye Donating Compound (3)

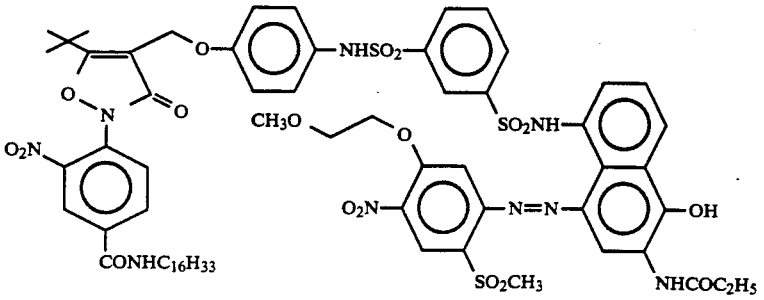

Electron Donor (1)

TABLE 7-continued

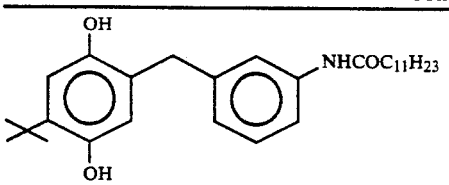

High Boiling Point Solvent (2)

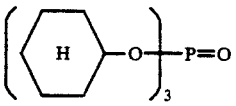

Electron Transfer Agent Precursor (3)

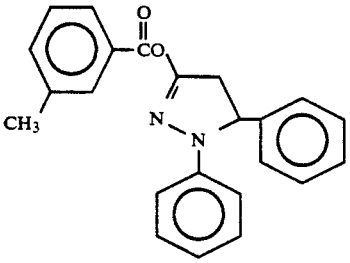

Compound (1)

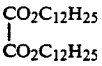

The method of preparation of the gelatin dispersion of the intermediate layer electron donor (4) is described below.

The electron donor (4) indicated below (23.6 grams) and 8.5 grams of the above mentioned high boiling point solvent (2) were added to 30 ml of ethyl acetate, and a uniform solution was obtained. This solution and 100 grams of 10% aqueous lime treated gelatin solution, 0.25 gram of sodium bisulfite, 0.3 gram of sodium dodecylbenzenesulfonate and 30 ml of water were mixed together by stirring and then dispersed at 10000 rpm for 10 minutes in a homogenizer. This dispersion is referred to as a gelatin dispersion of the electron donor (4).

Electron Donor 4

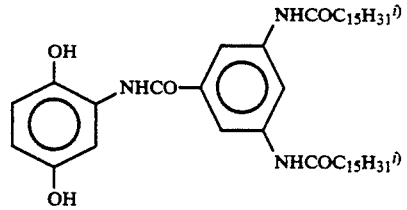

The multi-layer color photosensitive element (1) for diffusion transfer purposes of which the structure is shown in Table 8 was prepared using these dispersions etc.

TABLE 8

| Layer Number | Layer Name | Photosensitive Element (1) | Coated Weight (mg/m$^2$) |
|---|---|---|---|
| Sixth Layer | Protective layer | Gelatin | 900 |
| | | Silica (size 4μ) | 40 |
| | | Zinc hydroxide | 900 |
| | | Surfactant (5) (Note 1) | 130 |
| | | Surfactant (6) (Note 2) | 26 |
| | | Poly(vinyl alcohol) | 63 |
| | | Water soluble polymer (Note 3) | 8 |
| Fifth Layer | Blue Sensitive Emulsion Layer | Photosensitive silver halide emulsion | 380 as silver |
| | | Anti-fogging agent (7) (Note 4) | 0.9 |
| | | Gelatin | 560 |
| | | Yellow dye donating compound (1) | 400 |
| | | Electron donor (1) | 320 |
| | | Electron transfer agent precursor (3) | 25 |
| | | Compound A | 120 |
| | | High boiling point solvent (2) | 200 |
| | | Surfactant (8) (Note 5) | 45 |
| | | Water soluble polymer (Note 3) | 13 |
| Fourth Layer | Intermediate | Gelatin | 555 |

TABLE 8-continued

| | | | |
|---|---|---|---|
| | Layer | Electron donor (4) | 130 |
| | | High boiling point solvent (2) | 48 |
| | | Electron transfer agent (10) (Note 7) | 85 |
| | | Surfactant (6) (Note 2) | 15 |
| | | Surfactant (8) (Note 5) | 4 |
| | | Surfactant (9) (Note 6) | 30 |
| | | Poly(vinyl alcohol) | 30 |
| | | Water soluble polymer (Note 3) | 19 |
| | | Film hardening agent (11) (Note 8) | 37 |
| Third Layer | Green Sensitive Emulsion Layer | Photosensitive silver halide emulsion | 220 as silver |
| | | Anti-fogging agent (12) (Note 9) | 0.7 |
| | | Gelatin | 370 |
| | | Magenta dye donating compound (2) | 350 |
| | | Electron donor (1) | 195 |
| | | Electron transfer agent precursor (3) | 33 |
| | | High boiling point solvent (2) | 175 |
| | | Surfactant (8) (Note 5) | 47 |
| | | Water soluble polymer (Note 3) | 11 |
| Second Layer | Intermediate Layer | Gelatin | 650 |
| | | Zinc hydroxide | 300 |
| | | Electron donor (4) | 130 |
| | | High boiling point solvent (2) | 50 |
| | | Surfactant (6) (Note 2) | 11 |
| | | Surfactant (8) (Note 5) | 4 |
| | | Surfactant (9) (Note 6) | 50 |
| | | Poly(vinyl alcohol) | 50 |
| | | Water soluble polymer (Note 3) | 12 |
| | | Active carbon | 25 |
| First Layer | Red Sensitive Emulsion Layer | Photosensitive silver halide emulsion | 230 as silver |
| | | Anti-fogging agent (12) (Note 9) | 0.7 |
| | | Gelatin | 330 |
| | | Cyan dye donating compound (3) | 340 |
| | | Electron donor (1) | 133 |
| | | Electron transfer agent precursor (3) | 30 |
| | | High boiling point solvent (2) | 170 |
| | | Surfactant (8) (Note 5) | 40 |
| | | Water soluble polymer (Note 3) | 5 |
| Support | Polyethylene terephthalate 96μ (Carbon black coated in backing layer) | | |

(Note 1) Surfactant (5)

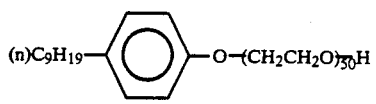

(Note 2) Surfactant (6)

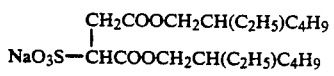

(Note 3) Water Soluble Polymer

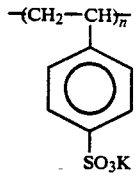

(Note 4) Anti-fogging Agent (7)

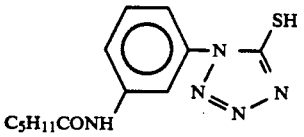

(Note 5) Surfactant (8)

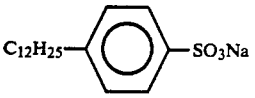

TABLE 8-continued (Note 6) Surfactant (9)

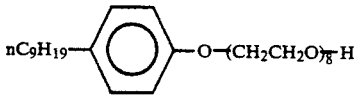

(Note 7) Electron Transfer Agent (10)

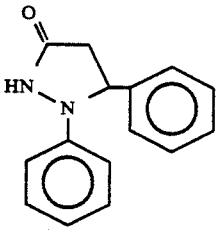

(Note 8) Film Hardening Agent (11) 1,2-Bis(vinylsulfonylacetamido)ethane
(Note 9) Anti-fogging Agent (12)

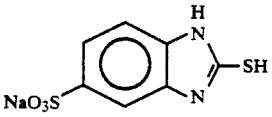

Photosensitive element (2) was then prepared in exactly the same way as photosensitive element (1) except that 200 mg/m$^2$ of κ-carrageenan was added to each of the second, fourth and sixth layers.

[II] Preparation of a Dye Fixing Element

A dye fixing element (1) which had the first to third coated layers coated on the support (1) which had been pre-coated with the first and second backing layers was prepared as shown in Table 9.

Moreover, the first to third layers were coated simultaneously with coated layer thicknesses of 15 cc/m$^2$, 40 cc/m$^2$ and 15 cc/m$^2$ respectively.

After coating, the sample was placed in a cold zone having a length of 10 meter at 20° C. and then it was dried in a draught of 30° C., 30% RH.

TABLE 9

Structure of Dye Fixing Element (1)

| Number | Additive | Amount Added (g/m$^2$) |
|---|---|---|
| Third Layer | Water soluble polymer (1) | 0.05 |
| | Silicone oil (1) | 0.04 |
| | Surfactant (1) | 0.001 |
| | Surfactant (2) | 0.02 |
| | Surfactant (3) | 0.10 |
| | Matting agent (1) | 0.02 |
| | Guanidine picolinate | 0.45 |
| | Gelatin | 0.24 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (5') | 0.15 |
| First Layer | Gelatin | 0.45 |
| | Surfactant (3) | 0.01 |
| | Water soluble polymer (1) | 0.04 |
| | Film hardening agent (1) | 0.30 |
| | Support (1) | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5') | 0.01 |
| | Matting agent (2) | 0.03 |

Structure of the Support (1)

| Layer Name | Composition | | Film Thickness (μ) |
|---|---|---|---|
| Surface Under-layer | Gelatin | | 0.1 |
| Surface PE Layer (Glossy) | Low density polyethylene (density 0.923) | 89.2 parts | 45.0 |
| | Surface treated titanium oxide | 10.0 parts | |

TABLE 9-continued

| | | | |
|---|---|---|---|
| | Ultramarine | 0.8 parts | |
| Pulp Layer | Top quality paper (LBKP/NBKP = 1:1) density 1.080 | | 92.6 |
| Reverse PE Layer (Matt) | High density polyethylene (density 0.960) | | 36.0 |
| Reverse Side Under-layer | Gelatin | | 0.05 |
| | Colloidal silica | | 0.05 |
| | | TOTAL | 173.8 |

Properties of Support (1)

| Item | Units | Physical Values | Measurement Method |
|---|---|---|---|
| Rigidity (length/width) | gram | 4.40/3.15 | T-Bar Rigidity Gauge |
| Whiteness | | L* 94.20<br>a* +0.12<br>b* −2.75 | CIE L*a*b* |

Silicone Oil (1)

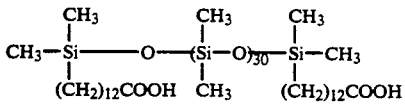

Surfactant (1)

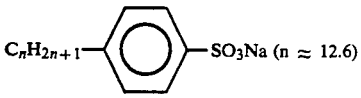

Surfactant (2)

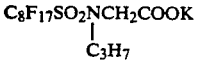

Surfactant (3)

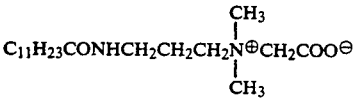

Surfactant (4)

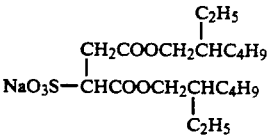

Fluorescent Whitener (1) 2,5-Bis(5-tert-butylbenzoxazole(2))thiophene

Surfactant (5')

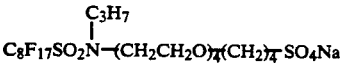

Water Soluble Polymer (1) Sumikagel L5-H (made by Sumitomo Chemical Co.)
Water Soluble Polymer (2) Dextran (molecular weight 70,000)

Mordant (1)

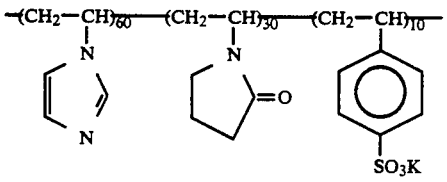

High Boiling Point Solvent (1)

TABLE 9-continued

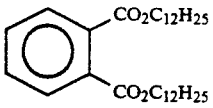

Film Hardening Agent (1)

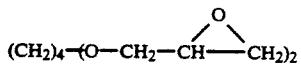

Matting Agent (1)* Silica
Matting Agent (2)* Benzoguanamine resin (average particle size 15μ)

Moreover, the dye fixing element (2) was prepared in the same way as dye fixing element (1) except that the gelatin in the third layer was replaced by the same amount of agar, Dye fixing element (3) was prepared in the same way as dye fixing element (1) except that the gelatin in the third layer was replaced by the same amount of κ-carrageenan. Dye fixing element (4) was prepared in the same way as dye fixing element (1) except that the gelatin in the third layer was replaced by the same amount of λ-carrageenan. Dye fixing element (5) was prepared in the same way as dye fixing element (1) except that the gelatin in the third layer was replaced by 0.05 g/m$^2$ of phaeceleran.

Moreover, the dye fixing element (6) was prepared in the same way as dye fixing element (3) except that the gelatin in the first layer of the dye fixing element (3) was replaced by the same amount of κ-carrageenan.

[III] Measurement of the Amount of Curl of a Dye Fixing Element

The dye fixing elements (1) to (6) which had been prepared were cut into 10 cm squares and left to stand with the third layer side uppermost on a flat surface, and the amount of curl (the average lift of the four corners) was measured after standing for 12 hours at 25° C., 20% RH.

The results obtained are shown in Table 10.

TABLE 10

| Dye Fixing Element | Curl (Average of four corners) | Remarks |
|---|---|---|
| (1) | 23 mm | Comp. Ex. |
| (2) | 13 mm | Invention |
| (3) | 14 mm | Invention |
| (4) | 12 mm | Invention |
| (5) | 14 mm | Invention |
| (6) | 10 mm | Invention |

It is clear from these results that the curl of a dye fixing element is improved by the inclusion of a natural macromolecular polysaccharide obtained by extraction and refinement from red algae.

[IV] Measurement of Color Shifting

Photosensitive element (1) was exposed using a tungsten lamp at 5000 lux for 1/10th second through B, G, R and gray color separation filters of which the density changed continuously.

The exposed photosensitive element was then fed at a line speed of 22 mm/sec, water was supplied at a rate of 15 ml/m$^2$ to the emulsion surface using a wire bar, and then this element was laminated immediately in contact with the film surface of each of the dye fixing elements (1) to (6).

The laminates were then heated for 15 seconds using a heated roller the temperature of which was controlled in such a way that the temperature of the film which had taken up the water was set at 85° C. On peeling away the dye fixing elements subsequently clear blue, green, red and gray images corresponding to the B, G, R and gray color separation filters were obtained without unevenness on the dye fixing elements.

Next, the coated surfaces of the parts of the image of maximum density ($D_{max}$) and minimum density ($D_{min}$) obtained were placed together face to face and subjected to a load of 2 kg/m$^2$, and after leaving to stand for 12 hours under conditions of 30° C., 70% RH, the density of the minimum density part was measured.

The results obtained were as shown in Table 11.

TABLE 11

| Dye Fixing Element | $D_{min}$ (Before Lamination) | | | $D_{min}$ (After Lamination) | | | |
|---|---|---|---|---|---|---|---|
| | Cyan | Magenta | Yellow | Cyan | Magenta | Yellow | Remarks |
| (1) | 0.12 | 0.17 | 0.14 | 0.18 | 0.26 | 0.20 | Comp. Ex. |
| (2) | 0.12 | 0.17 | 0.13 | 0.12 | 0.18 | 0.13 | Invention |
| (3) | 0.12 | 0.17 | 0.14 | 0.13 | 0.18 | 0.14 | Invention |
| (4) | 0.13 | 0.16 | 0.14 | 0.13 | 0.18 | 0.14 | Invention |
| (5) | 0.12 | 0.17 | 0.13 | 0.12 | 0.18 | 0.13 | Invention |

It is clear from Table 11 that the color transfer in the dye fixing elements containing natural macromolecular polysaccharides obtained by extraction and refinement from red algae is greatly improved.

[V] Measurement of Photographic Characteristics

Photosensitive elements (1) and (2) were exposed at 5000 lux for 1/10th second using a tungsten lamp through B, G, R and Gray color separation filters of a density which changed continuously.

The exposed photosensitive elements were fed at a line speed of 20 mm/sec, water was supplied to the emulsion surface at a rate of 15 ml/m$^2$ using a wire bar. Immediately afterwards they were laminated in such a way that the film surface was in contact with a dye fixing element (3).

The laminates were then heated for 15 seconds using a heated roller the temperature of which was controlled in such a way that the temperature of the film which had taken up the water was set to 85° C. On subsequently peeling away the dye fixing element, clear blue, green, red and gray images without unevenness corresponding to the B, G, R and gray color separation filters were obtained on the dye fixing elements.

Next, stored samples of the photosensitive elements (1) and (2) which had been stored for 6 days under conditions of 40° C., 75% RH were processed in exactly the same way as described above, and clear blue, green, red and gray images without unevenness were obtained.

The results obtained on measuring the maximum density ($D_{max}$) and minimum density ($D_{min}$) of the cyan, magenta and yellow colors are shown in Table 12.

Moreover, the test samples for which photosensitive elements (1) and (2) had been used immediately after coating were taken as samples A and the test samples obtained using the photosensitive elements (1) and (2) after storage at 40° C., 75% RH were taken as samples B.

TABLE 12

| Sample | Photo-sensitive Element | $D_{max}$ Cyan | $D_{max}$ Magenta | $D_{max}$ Yellow | $D_{min}$ Cyan | $D_{min}$ Magenta | $D_{min}$ Yellow | Remarks |
|---|---|---|---|---|---|---|---|---|
| Samples | (1) | 2.01 | 2.19 | 2.01 | 0.13 | 0.17 | 0.14 | Comp. Ex. |
| A | (2) | 2.02 | 2.19 | 2.00 | 0.12 | 0.17 | 0.14 | Invention |
| Samples | (1) | 2.02 | 2.18 | 2.00 | 0.21 | 0.23 | 0.20 | Comp. Ex. |
| B | (2) | 2.02 | 2.19 | 2.01 | 0.16 | 0.20 | 0.16 | Invention |

It is clear from Table 12 that there was reduced white base staining after ageing and storage with photosensitive element (2) which contained natural macromolecular polysaccharide which had been obtained by extraction and refinement from red algae.

EXAMPLE 2

The preparation of dye fixing element (7) is described below.

The dye fixing element (7) was prepared by providing a coated layer structure of the first to the third layers on a support (1) (the same as described in Example 1) which had been prepared by the pre-coating of the first and second backing layers on a support comprised of top quality paper which had been laminated with polyethylene.

Moreover, coating was carried out simultaneously in such a way that the coating liquid film thickness for the first to the third layers was 15 cc/m², 40 cc/m² and 15 cc/m² respectively.

After coating, the samples stood in a cooling zone having a length of 10 meter at 20° C. and were subsequently dried with a drying draught at 30° C., 30% RH.

TABLE 13

Structure of Dye Fixing Element (7)

| Number | Additive | Amount Added (g/m²) |
|---|---|---|
| Third Layer | Water soluble polymer (1) | 0.05 |
| | Silicone oil (1) | 0.04 |
| | Surfactant (1) | 0.001 |
| | Surfactant (2) | 0.02 |
| | Surfactant (3) | 0.10 |
| | Matting agent (1) | 0.02 |
| | Guanidine picolinate | 0.45 |
| | κ-Carrageenan | 0.12 |
| Second Layer | Mordant (1) | 2.35 |
| | Water soluble polymer (1) | 0.20 |
| | Gelatin | 1.40 |

TABLE 13-continued

Structure of Dye Fixing Element (7)

| Number | Additive | Amount Added (g/m²) |
|---|---|---|
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (5') | 0.15 |
| First Layer | Gelatin | 0.45 |
| | Surfactant (3) | 0.01 |
| | Water soluble polymer (1) | 0.04 |
| | Film hardening agent (1) | 0.30 |
| | Support (1) | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5') | 0.01 |
| | Matting agent (2) | 0.03 |

The preparation of the emulsions is described below.

Solution (I) and solution (II) of Table 15 were added over a period of 30 minutes to a thoroughly agitated aqueous gelatin solution (Table 14) which was being maintained at 50° C. Next, solution (III) and solution (IV) of Table 15 were added with the addition times shown in Table 17. The dye solution shown in Table 16 was also added as indicated in Table 17.

TABLE 14

| | |
|---|---|
| Gelatin | 20 grams |
| NaCl | 6 grams |
| KBr | 0.3 gram |
| Reagent A | 0.015 gram |
| $H_2O$ | 730 ml |

TABLE 15

| | Solution (I) in Water 200 ml | Solution (II) in Water 200 ml | Solution (III) in Water 200 ml | Solution (IV) in Water 200 ml |
|---|---|---|---|---|
| $AgNO_3$ | 50 grams | — | 50 grams | — |
| KBr | — | 21 grams | — | 28 grams |
| NaCl | — | 6.9 grams | — | 3.5 grams |

Reagent A

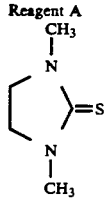

TABLE 16

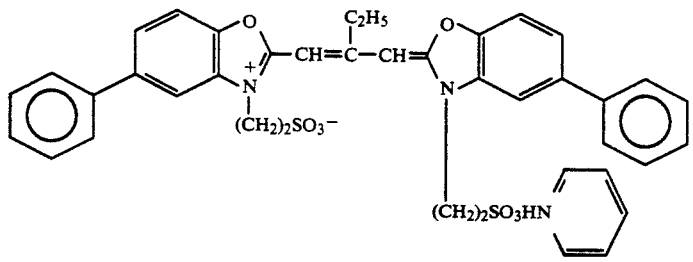

0.23 g

Methanol 60 ml

After water washing and de-salting at pH=4.0, 20 grams of gelatin was added and, after adjusting to pH 6.0, pAg 7.8, chemical sensitization was carried out optimally using triethylthiourea, chloroauric acid and 4-hydroxy-6-methyl-1,3,3a,7-tetra-azaindene.

Emulsions (1) to (3) shown in Table 17 were prepared in this way, and all of the emulsions obtained were cubic emulsions of average grain size 0.40 μ and the recovery in each case was 630 grams.

TABLE 17

| Emulsion | Average Grain Size | Variation Coefficient | (III), (IV) Solution Addition | Dye Added | Chemical Sensitization |
|---|---|---|---|---|---|
| (1) | 0.40μ | 0.47 | 2 minutes | After chemical sensitization | Gold/sulfur |
| (2) | 0.42μ | 0.18 | 30 minutes | After chemical sensitization | Gold sulfur |
| (3) | 0.39μ | 0.18 | 30 minutes | before chemical sensitization | Gold/sulfur |

The preparation of photosensitive elements 101–106 is described below.

The two-layer structure indicated below was coated onto a 100 μ PET support.

TABLE 18

| Layer Name | Content | Amount Coated (g/m²) |
|---|---|---|
| First Layer | $Zn(OH)_2$*1 | 0.77 |
| | Surfactant*2 | 0.02 |
| | Gelatin | 0.55 |
| Second Layer | Silver halide emulsion (as Ag) | 0.26 |
| | Anti-fogging agent*3 | $7.68 \times 10^{-4}$ |
| | Dye donating substance*4 | 0.36 |
| | Electron transfer agent*5 | 0.08 |
| | Electron donating substance*6 | 0.20 |
| | Gelatin | 0.56 |
| | Surfactant*7 | 0.04 |
| | κ-Carrageenan | as shown in Table 19 |

*1The coating liquid was prepared using the dispersion of zinc hydroxide described in Example 1.
*2Surfactant (5) shown in note 1 of Example 1.
*3Anti-fogging agent (12) shown in note 9 of Example 1.
*4The coating liquid was prepared with the gelatin dispersion of the dye donating compound (2) dye donating substance of Example 1.
*5The coating liquid was prepared using the electron transfer agent dispersion described in Example 1.
*6Electron donor (1) shown in Example 1.
*7Surfactant (8) shown in note 5 of Example 1.

The photosensitive element was exposed at 5000 lux for 1/10th second using a tungsten lamp through a gray filter of which the density charged continuously.

The exposed photosensitive elements were fed at a line speed of 20 mm/sec, water was supplied to the emulsion surface at a rate of 15 ml/m² using a wire bar and immediately afterwards they were laminated in such a way that the film surface was in contact with the dye fixing elements (7), respectively.

The laminates were then heated for 15 seconds using a heated roller of which the temperature was controlled in such a way that the temperature of the film which had taken up the water was set to 85° C. On subsequently peeling away the dye fixing element, clear magenta images without unevenness were obtained on the dye fixing elements.

The results obtained on measuring the magenta densities of the images obtained using an automatic recording type densitometer are shown in Table 19.

TABLE 19

| Photosensitive Element No. | Emulsion No. | Carrageenan in the Second Layer | $D_{max}$ | $D_{min}$ | Speed* |
|---|---|---|---|---|---|
| 101 | (1) | None | 1.67 | 0.14 | 0 |
| 102 | (1) | 0.04 g/m² | 1.82 | 0.14 | +0.01 |
| 103 | (2) | None | 1.90 | 0.14 | +0.15 |
| 104 | (2) | 0.04 g/m² | 2.03 | 0.14 | +0.15 |
| 105 | (3) | None | 2.01 | 0.14 | +0.27 |
| 106 | (3) | 0.04 g/m² | 2.15 | 0.14 | +0.28 |

*The speed is represented by the logarithm of the reciprocal of the exposure required to provide a density of 0.6. (Sample 101 is taken as 0 for comparison)

It is clear from the results shown in Table 19 that $D_{max}$ is increased by the effect of κ-carrageenan. When emulsion (2) or emulsion (3) was used, $D_{max}$ was increased and ideal $D_{max}$ values were obtained.

EXAMPLE 3

A photosensitive element was prepared as shown in Table 20.

TABLE 20

| Layer Number | Layer Name | Structure of the Photosensitive Element | Coated Weight (mg/m²) |
|---|---|---|---|
| Sixth Layer | Protective layer | Gelatin | 900 |
| | | Silica (size 4μ) | 40 |
| | | Zinc hydroxide | 900 |

TABLE 20-continued

| Layer Number | Layer Name | Structure of the Photosensitive Element | Coated Weight (mg/m²) |
|---|---|---|---|
| | | Surfactant (5) (Note 1) | 130 |
| | | Surfactant (6) (Note 2) | 26 |
| | | Poly(vinyl alcohol) | 63 |
| | | Lactose | 155 |
| | | κ-Carrageenan | Table 21 |
| | | Water soluble polymer (Note 3) | 8 |
| Fifth Layer | Blue Sensitive Emulsion Layer | Photosensitive silver halide emulsion | 380 as silver |
| | | Anti-fogging agent (7) (Note 4) | 0.9 |
| | | Gelatin | 560 |
| | | Yellow dye donating compound (1) | 400 |
| | | Electron donor (1) | 320 |
| | | Electron transfer agent precursor (3) | 25 |
| | | Compound A | 120 |
| | | High boiling point solvent (2) | 200 |
| | | Surfactant (8) (Note 5) | 45 |
| | | Water soluble polymer (Note 3) | 13 |
| Fourth Layer | Intermediate Layer | Gelatin | 555 |
| | | Electron donor (4) | 130 |
| | | High boiling point solvent (2) | 48 |
| | | Electron transfer agent (10) (Note 7) | 85 |
| | | Surfactant (6) (Note 2) | 15 |
| | | Surfactant (8) (Note 5) | 4 |
| | | Surfactant (9) (Note 6) | 30 |
| | | Poly(vinyl alcohol) | 30 |
| | | Lactose | 155 |
| | | Water soluble polymer (Note 3) | 19 |
| | | Film hardening agent (11) (Note 8) | 37 |
| Third Layer | Green Sensitive Emulsion Layer | Photosensitive silver halide emulsion | 220 as silver |
| | | Anti-fogging agent (12) (Note 9) | 0.7 |
| | | Gelatin | 370 |
| | | Electron donor (1) | 195 |
| | | Magenta dye donating compound (2) | 350 |
| | | Electron transfer agent precursor (3) | 33 |
| | | High boiling point solvent (2) | 175 |
| | | Surfactant (8) (Note 5) | 47 |
| | | Water soluble polymer (Note 3) | 11 |
| Second Layer | Intermediate Layer | Gelatin | 650 |
| | | Zinc hydroxide | 300 |
| | | Electron donor (4) | 130 |
| | | High boiling point solvent (2) | 50 |
| | | Surfactant (6) (Note 2) | 11 |
| | | Surfactant (8) (Note 5) | 4 |
| | | Surfactant (9) (Note 6) | 50 |
| | | Poly(vinyl alcohol) | 50 |
| | | Lactose | 155 |
| | | Water soluble polymer (Note 3) | 12 |
| | | Active carbon | 25 |
| First Layer | Red Sensitive Emulsion Layer | Photosensitive silver halide emulsion | 330 as silver |
| | | Anti-fogging agent (12) (Note 9) | 0.7 |
| | | Gelatin | 330 |
| | | Cyan dye donating compound (3) | 340 |
| | | Electron donor (1) | 133 |
| | | Electron transfer agent precursor (3) | 30 |
| | | High boiling point solvent (2) | 170 |
| | | Surfactant (8) (Note 5) | 40 |
| | | Water soluble polymer (Note 3) | 5 |
| Support | Polyethylene terephthalate 96μ (Carbon black coated in backing layer) | | |

Images were formed in the same way as in Example 2 using this photosensitive element and the dye fixing elements indicated in Example 2 and the following results were obtained.

TABLE 21

| Photosensitive Material No. | 6th Layer Carrageenan | Maximum Density Cyan | Magenta | Yellow |
|---|---|---|---|---|
| 201 | None | 2.21 | 2.21 | 2.20 |
| 202 | 12 mg/m² | 2.32 | 2.38 | 2.32 |

It is clear from the results shown in Table 21 that the photosensitive element of the present invention is an excellent photosensitive element which has a high maximum density.

EXAMPLE 4

The preparation of photosensitive material 401 is described below.

Photosensitive Silver Halide Emulsion (for the Red Sensitive Emulsion Layer)

Solution (I) and solution (II) indicated below were added simultaneously at an even flow rate over a period of 30 minutes to a thoroughly agitated aqueous gelatin solution (obtained by adding 20 grams of gelatin, 0.3 gram of potassium bromide, 6 grams of sodium chloride and 30 mg of reagent A indicated below to 800 ml of water and maintaining at 50° C.). Subsequently, solution (III) and solution (IV) indicated below were added simultaneously over a period of 30 minutes. Furthermore, a solution of a mixture of the dyes indicated below was added starting 3 minutes after the commencement of the addition of solutions (III) and (IV).

After washing with water and de-salting, 22 grams of lime treated ossein gelatin was added and, after adjustment to pH 6.2 and pAg 7.7, sodium thiosulfate and 4-hydroxy-6-methyl-1,3,3a,7-tetra-azaindene and chloroauric acid were added and the mixture was chemically sensitized optimally at 60° C. A mono-disperse cubic silver chlorobromide emulsion of average grain size 0.38 μ was obtained in this way. The recovery was 635 grams.

| | Solution (I) | Solution (II) | Solution (III) | Solution (IV) |
|---|---|---|---|---|
| $AgNO_3$ | 50.0 grams | — | 50.0 grams | — |
| KBr | — | 28.0 grams | — | 35.0 grams |
| NaCl | — | 3.4 grams | — | — |
| $H_2O$ to: | 200 ml | 200 ml | 200 ml | 200 ml |

Reagent A

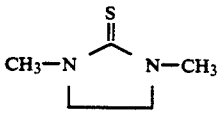

Sensitizing Dye

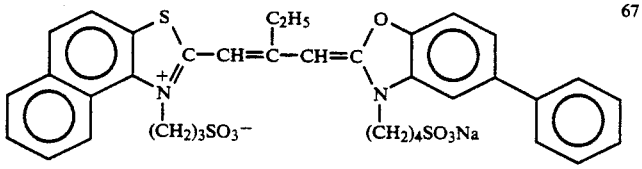

67 mg

Sensitizing Dye

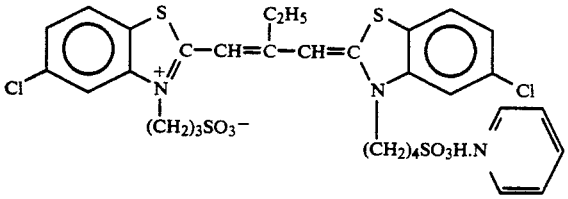

133 mg

Photosensitive Layer Silver Halide Emulsion (For the Green Sensitive Emulsion Layer)

Solution (I) and solution (II) indicated below were added simultaneously over a period of 30 minutes to a thoroughly agitated aqueous gelatin solution (obtained by adding 20 grams of gelatin, 0.30 gram of potassium bromide, 6 grams of sodium chloride and 0.015 gram of reagent A to 730 ml of water and maintaining at 60° C.). Next, solution (III) and solution (IV) indicated below were added over a period of 30 minutes, and a solution of the dye indicated below was added 1 minute after completion of this addition.

After washing with water and de-salting, 20 grams of gelatin was added and chemical sensitization was carried out optimally using pH adjusted triethylthiourea, chloroauric acid and 4-hydroxy-6-methyl-1,3,3a, 7-tetra-azaindene.

The emulsion obtained was a mono-disperse cubic emulsion of an average grain size 0.40 μm, and the recovery was 630 grams.

| | Solution (I) | Solution (II) | Solution (III) | Solution (IV) |
|---|---|---|---|---|
| $AgNO_3$ | 50.0 grams | — | 50.0 grams | — |
| KBr | — | 21.0 grams | — | 28.0 grams |
| NaCl | — | 6.9 grams | — | 3.5 grams |
| $H_2O$ to: | 200 ml | 200 ml | 200 ml | 200 ml |

Sensitizing Dye

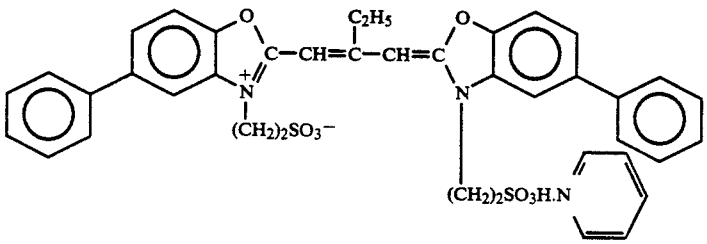

230 mg

Photosensitive Silver Halide Emulsion (For the Blue Sensitive Emulsion Layer)

| | Solution (I) | Solution (II) | Solution (III) | Solution (IV) |
|---|---|---|---|---|
| $AgNO_3$ | 30.0 grams | — | 70.0 grams | — |
| KBr | — | 17.8 grams | — | 49.0 grams |
| NaCl | — | 1.6 grams | — | — |
| $H_2O$ to: | 180 ml | 180 ml | 350 ml | 350 ml |

Sensitizing Dye

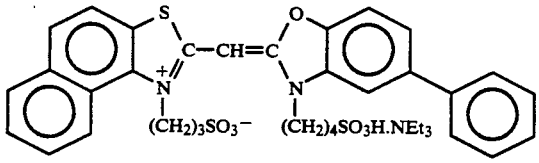

180 mg

Sensitizing Dye

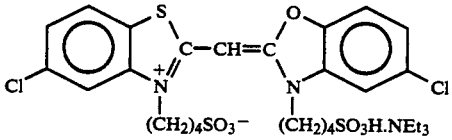

60 mg

Solution (I) and solution (II) indicated below were added simultaneously over a period of 30 minutes to a thoroughly agitated aqueous gelatin solution (obtained by adding 20 grams of gelatin, 3 grams of potassium bromide, 0.03 gram of reagent A indicated below and 0.25 gram of $HO(CH_2)_2S(CH_2)_2S(CH_2)_2OH$ to 800 ml of water and maintaining at 50° C.). Subsequently, solution (III) and solution (IV) indicated below were added simultaneously over a period of 20 minutes. Furthermore, a solution of the two dyes indicated below was added 5 minutes after the commencement of the addition of solution (III).

After washing with water and desalting, 20 grams of lime treated ossein gelatin was added and, after adjusting to pH 6.2 and pAg 8.5, sodium thiosulfate and 4-hydroxy-6-methyl-1,3,3a,7-tetra-azaindene and chloroauric acid were added, and the mixture was chemically sensitized optimally. Six hundred grams of a mono-disperse tetradecahedral silver iodobromide emulsion of an average grain size 0.40 μ was obtained in this way.

The preparation of the gelatin dispersion of the electron donor (4) for the intermediate layer is described below.

The electron donor (4) indicated below (23.6 grams) and 8.5 grams of the above mentioned high boiling point solvent (2) were added to 30 ml of ethyl acetate and heated to 60° C., and a uniform solution was obtained. This solution and 100 grams of 10% aqueous lime treated gelatin solution, 0.25 gram of sodium bisulfite, 0.3 gram of sodium dodecylbenzenesulfonate and 30 ml of water were mixed together by stirring and then dispersed at 10000 rpm for 10 minutes in a homogenizer. This dispersion is referred to as the gelatin dispersion of the electron donor (4).

The dispersions of zinc hydroxide, active carbon and electron transfer agent, and the gelatin dispersions of the dye donating compounds, were prepared in the same way as described in Example 1.

TABLE 22

Structure of the Photosensitive Material 401

| Layer Number | Layer Name | | Coated Weight (mg/m²) |
|---|---|---|---|
| Sixth Layer | Protective layer | Gelatin | 900 |
| | | Silica (size 4μ) | 40 |
| | | Zinc hydroxide | 900 |
| | | Surfactant (5) | 130 |
| | | Surfactant (6) | 26 |
| | | Poly(vinyl alcohol) | 63 |
| | | Lactose | 155 |
| | | Water soluble polymer | 8 |
| Fifth Layer | Blue Sensitive Emulsion Layer | Photosensitive silver halide emulsion | 380 as silver |
| | | Anti-fogging agent (7) | 0.9 |
| | | Gelatin | 560 |
| | | Yellow dye donating compound (1) | 400 |
| | | Electron donor (1) | 320 |
| | | Electron transfer agent precursor (3) | 25 |
| | | High boiling point solvent (2) | 200 |
| | | Surfactant (8) | 45 |
| | | Water soluble polymer | 13 |
| Fourth Layer | Intermediate Layer | Gelatin | 555 |
| | | Electron donor (4) | 130 |
| | | High boiling point solvent (2) | 48 |
| | | Electron transfer agent (10) | 85 |
| | | Surfactant (6) | 15 |
| | | Surfactant (8) | 4 |

TABLE 22-continued

| Structure of the Photosensitive Material 401 | | | |
|---|---|---|---|
| Layer Number | Layer Name | | Coated Weight (mg/m$^2$) |
| | | Surfactant (9) | 30 |
| | | Poly(vinyl alcohol) | 30 |
| | | Lactose | 155 |
| | | Water soluble polymer | 19 |
| | | Film hardening agent (11) | 37 |
| Third Layer | Green Sensitive Emulsion Layer | Photosensitive silver halide emulsion | 220 as silver |
| | | Anti-fogging agent (12) | 0.7 |
| | | Gelatin | 370 |
| | | Electron donor (1) | 195 |
| | | Magenta dye donating compound (2) | 350 |
| | | Electron transfer agent precursor (3) | 33 |
| | | High boiling point solvent (2) | 175 |
| | | Surfactant (8) | 47 |
| | | Water soluble polymer | 11 |
| Second Layer | Intermediate Layer | Gelatin | 650 |
| | | Zinc hydroxide | 300 |
| | | Electron donor (4) | 130 |
| | | High boiling point solvent (2) | 50 |
| | | Surfactant (6) | 11 |
| | | Surfactant (8) | 4 |
| | | Surfactant (9) | 50 |
| | | Poly(vinyl alcohol) | 50 |
| | | Lactose | 155 |
| | | Water soluble polymer | 12 |
| | | Active carbon | 25 |
| First Layer | Red Sensitive Emulsion Layer | Photosensitive silver halide emulsion | 230 as silver |
| | | Anti-fogging agent (12) | 0.7 |
| | | Gelatin | 330 |
| | | Cyan dye donating compound (3) | 340 |
| | | Electron donor (1) | 133 |
| | | Electron transfer agent precursor (3) | 30 |
| | | High boiling point solvent (2) | 170 |
| | | Surfactant (8) | 40 |
| | | Water soluble polymer | 5 |
| Support | Polyethylene terephthalate 96μ (Carbon black coated in backing layer) | | |

The preparation of the image receiving materials is described below.

The image receiving material 401 which had coated layers of the structure of the first to the third coated layers coated on the support (1) (the same as described in Example 1) Which had been pre-coated with the first and second backing layers was prepared as shown in Table 23 below. No hydrophilic organic solvent was used in the dissolution or dispersion in water of the components shown in the Table when preparing the coating liquid for the third layer.

Moreover, the first to third layers were coated simultaneously with a multi-layer coating system with coated layer thicknesses of 15 ml/m$^2$, 40 ml/m$^2$ and 15 ml/m$^2$ respectively for the first to the third layers.

After coating, the sample was placed in a cold zone having a length of 10 meter at 20° C. and then it was dried in a draught of 30° C., 30% RH.

TABLE 23

| Structure of Image Receiving Material 401 | | |
|---|---|---|
| Number | Additive | Amount Added (g/m$^2$) |
| Third Layer | Water soluble polymer (1) | 0.05 |
| | Silicone oil (1) | 0.04 |
| | Surfactant (1) | 0.001 |
| | Surfactant (2) | 0.02 |
| | Surfactant (3) | 0.10 |
| | Matting agent (1) | 0.02 |
| | Guanidine picolinate | 0.45 |
| | κ-Carrageenan | 0.24 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |

TABLE 23-continued

| Structure of Image Receiving Material 401 | | |
|---|---|---|
| Number | Additive | Amount Added (g/m$^2$) |
| | Fluorescent whitener (1) | 0.05 |
| | Surfactant (5') | 0.15 |
| First Layer | Gelatin | 0.45 |
| | Surfactant (3) | 0.01 |
| | Water soluble polymer (1) | 0.04 |
| | Film hardening agent (1) | 0.30 |
| | Support (1) | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5') | 0.01 |
| | Matting agent (2) | 0.03 |

Image receiving material 402 was prepared by a different method for the addition of the κ-carrageenan. First of all, the κ-carrageenan was dispersed in five times it weight of methanol. Next, water was added to the dispersion and a 3 wt.% aqueous κ-carrageenan solution was prepared. In this case, the κ-carrageenan dissolved rapidly in the water and no lumps were formed. This solution of κ-carrageenan was added to the coating liquid for the third layer and coated in the same way as for image receiving material 401.

Processing with the photosensitive material and image receiving materials described above was carried out as indicated below.

Thus, the photosensitive material 401 was exposed at 5000 lux for 1/10th second to tungsten light through a gray wedge of which the density changed continuously.

Next, the exposed photosensitive materials were fed at a line speed of 20 mm/sec, water was supplied to the emulsion surface at a rate of 15 ml/m$^2$ using a wire bar. Immediately afterwards they were laminated in such a way that the film surfaces were in contact with an image receiving material. The laminates were then heated for 15 seconds using a heated roller of which the temperature was controlled in such a way that the temperature of the film which had taken up the water was set to 85° C., and on subsequently peeling away the image receiving material, clear gray images were obtained on the image receiving materials.

The unevenness of the density of the parts of average density 1.0 for Y (yellow), M (magenta) and Cy (cyan) of the gray part was measured using a micro-densitometer (beam diameter 0.5 mm) and the results obtained are shown in Table 24 below.

TABLE 24

| | Image Receiving Material | Density Unevenness | | |
|---|---|---|---|---|
| | | Y | M | C |
| Comp. Ex. | 401 | 6% | 7% | 6% |
| Invention | 402 | 2% | 3% | 2% |

$$\text{Density Unevenness} = \frac{[\text{Maximum Density}] - [\text{Minimum Density}]}{\text{Average Density}}$$

(Here, the maximum density and the minimum density are the values in the part of average density 1.0)

It is clear from the data in Table 24 above that uniform coating can be achieved when coating using solutions obtained by dissolving a water soluble polymer (carrageenans) in a solution containing hydrophilic organic solvent and water is used in accordance with this present invention, and that there is a pronounced improvement in coating unevenness as a result of this and that the occurrence of density unevenness in the transferred image originating from the coating unevenness can be suppressed.

While the invention has been described in detailed with reference to specific embodiments, it will be apparent to one skilled in the art that various changes and modifications can be made to the invention without departing from its spirit and scope.

What is claimed is:

1. A diffusion transfer photographic material comprising a support having thereon at least a photosensitive element comprising a photosensitive silver halide emulsion and a diffusible dye donating compound, and a dye fixing element which is adapted to be placed upon said photosensitive element at the time of image transfer, wherein a natural macromolecular polysaccharide originating from red algae is included in a protective layer coated over a dye fixing layer of said dye fixing element.

2. A diffusion transfer photographic material as in claim 1 wherein the natural macromolecular polysaccharide originating from red algae is a natural macromolecular polysaccharide selected from among agar, κ-carrageenan, λ-carrageenan, ι-carrageenan and phaeceleran.

3. A diffusion transfer photographic material as in claim 1, wherein the photosensitive element further comprises a binder, an electron transfer agent, an electron donor, and a reducible dye donating compound which releases a diffusible dye on reduction.

4. A diffusion transfer photographic material as in claim 3 wherein at least one photosensitive silver halide emulsion is a gold/sulfur sensitized mono-disperse emulsion.

5. A diffusion transfer photographic material as disclosed in claim 3 wherein at least one photosensitive silver halide emulsion has a sensitizing dye adsorbed before chemical sensitization.

6. A process of producing a diffusion transfer photographic material comprising a support having thereon at least a photosensitive element comprising a photosensitive silver halide emulsion and a diffusible dye donating compound, and a dye fixing element which is adapted to be placed upon said photosensitive element at the time of image transfer, which comprises the step of coating a coating liquid which comprises a natural macromolecular polysaccharide originating from red algae, a hydrophilic organic solvent in which the polysaccharide is essentially insoluble and water, onto a dye fixing layer of said dye fixing element to form a protective layer.

* * * * *